US010953518B2

(12) United States Patent
Parras

(10) Patent No.: US 10,953,518 B2
(45) Date of Patent: Mar. 23, 2021

(54) LOCKING SYSTEM FOR SUSPENDED LOADS

(71) Applicant: Parras Engineering Inc., North Vancouver (CA)

(72) Inventor: Michael Parras, North Vancouver (CA)

(73) Assignee: PARRAS ENGINEERING INC., North Vancouver (CA)

( * ) Notice: Subject to any disclaimer, the term of this patent is extended or adjusted under 35 U.S.C. 154(b) by 0 days.

(21) Appl. No.: 16/194,099

(22) Filed: Nov. 16, 2018

(65) Prior Publication Data

US 2019/0255680 A1 Aug. 22, 2019

Related U.S. Application Data

(60) Provisional application No. 62/587,314, filed on Nov. 16, 2017.

(51) Int. Cl.
*B25B 5/08* (2006.01)
*B66D 3/02* (2006.01)

(52) U.S. Cl.
CPC . *B25B 5/08* (2013.01); *B66D 3/02* (2013.01)

(58) Field of Classification Search
CPC ..... B25B 5/08; B66D 3/02; F16B 2/18; F16B 2/185
See application file for complete search history.

(56) References Cited

U.S. PATENT DOCUMENTS 2,995,339 A 8/1961 Persiaux
3,222,742 A 12/1965 Persiaux
(Continued)

OTHER PUBLICATIONS

Griphoist-Tirfir Service and Maintenance Manual; Tractel Group, Griphoist Division, Version 2a, Date: Apr. 5, 2004, Apr. 5, 2004.
(Continued)

*Primary Examiner* — Lee D Wilson
(74) *Attorney, Agent, or Firm* — Oyen Wiggs Green & Mutala LLP

(57) ABSTRACT

An elongated cam pin for use in a clamping assembly, the pin comprising a first half-round portion and a second half-round portion laterally offset from the first half-round portion, wherein the centers of the first and second half-round portions are spaced-apart a distance S along a diametral center line of the pin, wherein each of the half-round portions has a radius R and a diameter D equal to 2R, and wherein the ratio D/S is between approximately 2 and approximately 3. In one embodiment the ratio D/S is approximately 2.3. In some embodiments rotation of the cam pin within the clamping assembly is actuated by a shaft having a relatively short stroke length. In some embodiments the cam pin is rotatable within the clamping assembly through an arc of up to approximately 40°. In some embodiments the actuating shaft is movable within the housing of a compact locking apparatus to cause the clamping assembly to releasably engage a restraint cable in a self-gripping fashion. In some embodiments the locking apparatus may be used in a locking system designed to safely lock a suspended load at a desired location relative to the cable. In some embodiments the cable is at least one inch in diameter and the diameter D of each of the half-round pins is approximately 1.75 times the diameter of the cable. In some embodiments the suspended load may comprise a bin floor and any supported lumber travelling between loading and discharge positions in a lumber sorting apparatus.

30 Claims, 21 Drawing Sheets

(56) References Cited

U.S. PATENT DOCUMENTS 3,410,525 A 11/1968 Tanson
3,852,943 A * 12/1974 Healy ..... A62B 1/14 24/134 R
4,077,094 A * 3/1978 Swager ..... A62B 1/14 182/5
4,429,599 A * 2/1984 La Sante, Sr. ..... B25B 15/004 411/404
4,923,350 A * 5/1990 Hinksman ..... F16L 37/144 411/457
5,152,564 A * 10/1992 Martineau ..... E05C 7/00 200/61.62
5,924,522 A * 7/1999 Ostrobrod ..... E06C 7/186 182/191
5,934,408 A * 8/1999 Flux ..... A62B 35/04 182/192
6,047,620 A * 4/2000 Kozak ..... B25B 13/485 81/441
7,905,164 B2 * 3/2011 Kozak ..... B25B 13/485 81/453
8,087,328 B2 * 1/2012 Kozak ..... B25B 13/485 81/453
2003/0051944 A1 * 3/2003 Shea ..... A62B 1/14 182/193
2014/0259397 A1 * 9/2014 McReynolds ..... A47C 20/041 5/412
2019/0255680 A1 * 8/2019 Parras ..... B25B 5/08

OTHER PUBLICATIONS

LockNSafe Lumber Sorter Bin Restraint System, (c) 2014 LNS Services, https://web.archive.org.web/20150216021 6021932/http://www.lock-n-safe.com/support.html, Feb. 16, 2015, retrieved Oct. 14, 2020.

Product Information, Lock 'N' Safe Lumber Sorter Bin Restraint System, LNS Services, V 1.0, Mar. 2014.

Lock 'N' Safe Operating & Maintenance Manual, Version 1.8, LNS Services, undated, https://www.lock-n-safe.com/support.html retrieved Oct. 23, 2020.

Lock 'N' Safe Lumber Sorter Bin Restraint Systems, 2005 Corporate & Training Video, http://roamingpictures.com/projects/lock-n-safe, retrieved Oct. 23, 2020.

* cited by examiner

FIG. 1B
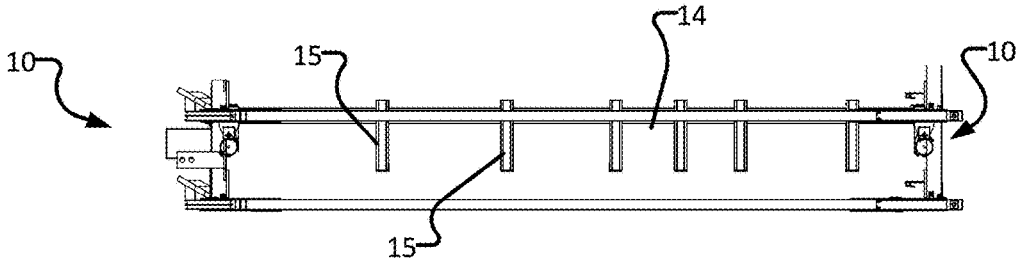
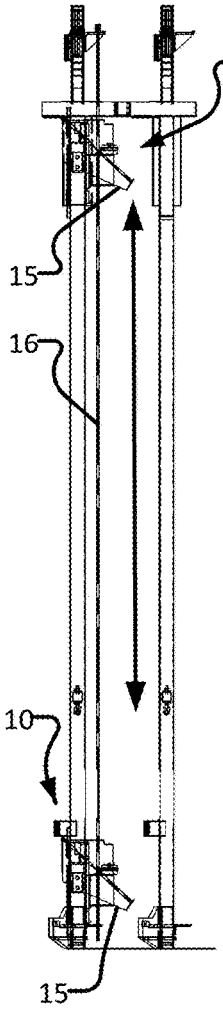
FIG. 1C
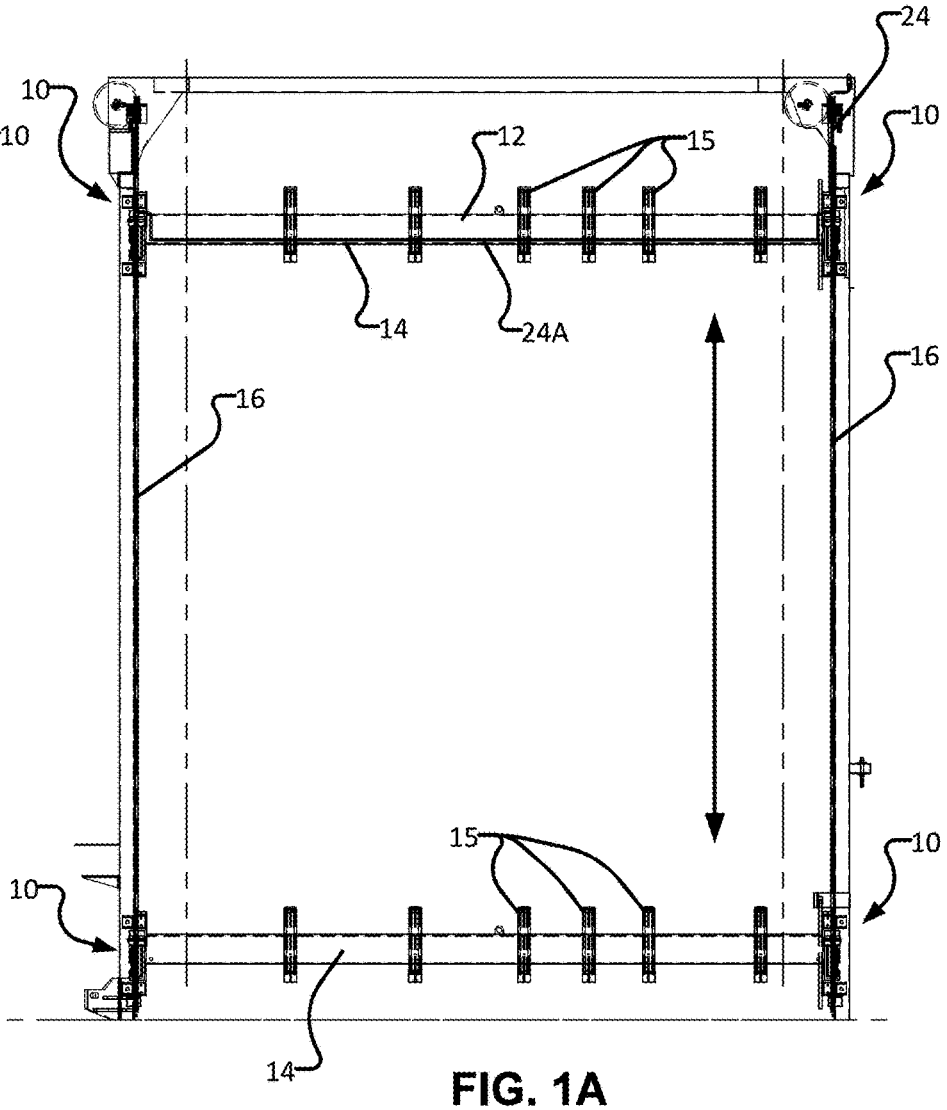
FIG. 1A

D/S ratio = 2

D/S ratio = 2.3

D/S ratio = 2.5

D/S ratio = 3

LOCKING SYSTEM FOR SUSPENDED LOADS

REFERENCE TO RELATED APPLICATIONS

This application claims the benefit of U.S. provisional patent application No. 62/587,314 entitled LOCKING SYSTEM FOR SUSPENDED LOADS filed 16 Nov. 2017 which is hereby incorporated herein by reference in its entirety for all purposes.

TECHNICAL FIELD

This application relates to a locking system for suspended loads, such as a movable lumber bin floor.

BACKGROUND

Locking systems for suspended loads are known in the prior art. In some cases the purpose of such systems is to releasably lock a load at a selected position in order to allow workers to safely work underneath the load. Once the work is completed the lock can be disengaged. For example, such systems may be used to lock a bin floor in a lumber sorting mill which, in operation, travels vertically in a reciprocating cycle between a lumber loading position and a lumber discharge position.

Some prior art systems employ clamps for mechanically gripping a metal cable. Some exemplary prior art clamping systems are described in U.S. Pat. No. 2,995,339 issued 8 Aug. 1961 and U.S. Pat. No. 3,410,525 issued 12 Nov. 1968 which are hereby incorporated by reference. Such clamping systems employ a plurality of cam pins each comprising first and second laterally offset half-round portions. Each cam pin is rotatably adjustable to cause clamping surfaces to releasably engage or disengage a cable.

The need has arisen for locking systems comprising improved cable clamping mechanisms. One problem that has arisen with some prior art systems is that the clamp surfaces may slip relative to the cable, particularly at higher loads. This causes wear of the clamping components and may eventually result in complete failure of the locking system, posing a very significant safety hazard. In order to guard against this possibility the clamping components require more frequent inspection and replacement.

It is possible to engineer cable clamps to grip a cable with more force by increasing the stroke length of the actuator which controls rotation of the cam pin. However, increasing the stroke length of the actuator can increase the overall size of the locking system which is disadvantageous in some applications. For example, if the locking system is mounted on the bin floor of lumber sorting apparatus it is desirable that the system have a very compact size to avoid interfering with the loading and unloading of lumber deposited into the bin.

As described herein the relative spacing of the half-round portions of the cam pin may be altered to increase the clamping force applied to the cable without appreciably increasing the stroke length of the actuator, thereby maintaining the compact size of the locking system. However, if the spacing is increased such that the ratio of the half-round pin diameter and the center-to-center spacing is below an optimum range, the amount of force applied to the cable may cause the internal components of the locking system to deform, such as by thinning or bending of the metal at stress locations. This in turn requires more frequent replacement of clamp components and/or the use of higher grade metal components, increasing the overall cost of the locking system.

The need has therefore arisen for an improved locking system for suspended loads having a compact size which employs cam pins suitable for high load applications.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In one aspect an elongated cam pin for use in a clamping apparatus is provided, the pin comprising a first half-round portion and a second half-round portion laterally offset from the first half-round portion, wherein the centers of the first and second half-round portions are spaced-apart a distance S along a diametral center line of the pin, wherein each of the half-round portions has a radius R and a diameter D equal to 2R, and wherein the ratio D/S is between approximately 2 and approximately 3.

In another aspect a locking apparatus for releasably engaging a cable is provided, wherein said locking apparatus comprises a clamping assembly comprising at least one rotatable cam pin comprising a first half-round portion and a second half-round portion laterally offset from said first half-round portion, wherein the centers of said first and second half-round portions are spaced-apart a distance S along a diametral center line of said pin, wherein each of said half-round portions has a radius R and a diameter D equal to 2R, wherein diameter D is approximately 1.75 times the diameter of said cable and wherein the ratio D/S as defined above is between approximately 2 and approximately 3.

In another aspect a locking apparatus for locking a suspended load at a desired location relative to a fixed cable is provided, wherein the locking apparatus has a working load capacity of at least 15,000 lbs and wherein the locking apparatus comprises at least one cam pin rotatable between a fully open release position and a fully closed clamping position, wherein the arc of rotation of the cam pin between the fully open and fully closed positions is approximately 40° or less. In some aspects rotation of the cam pin is actuated by a shaft having a stroke length of 3 inches or less and the at least one cam pin has a ratio of D/S as defined above between approximately 2 and approximately 3.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced figures of the drawings. It is intended that the embodiments and figures disclosed herein are to be considered illustrative rather than restrictive.

FIG. 1A is a front elevational view of the applicant's locking system comprising a pair of locking apparatuses installed on a lumber bin floor of a lumber sorting apparatus and showing the bin floor reciprocating between a lumber loading position and a lumber discharge position.

FIG. 1B is a top plan view of the lumber sorting apparatus of FIG. 1A.

FIG. 1C is side elevational view of the lumber sorting apparatus of FIG. 1A.

DESCRIPTION

Figure 2B:
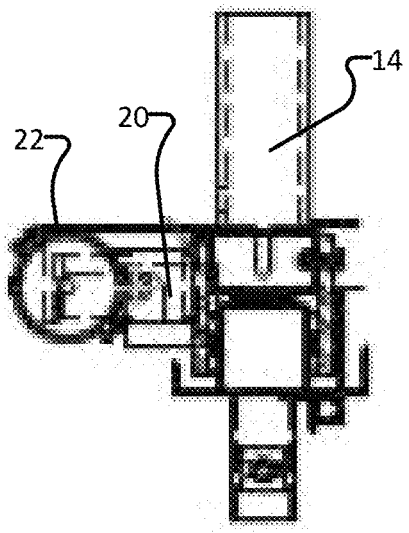
FIG. 2B is an enlarged top plan view of the locking apparatus of FIG. 2A.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

This application relates to a locking system for locking a suspended load at a desired location. In some embodiments the locking system comprises a locking apparatus 10 for releasably locking a load 12 at a desired vertical position. In some embodiments the locking system comprises a pair of locking apparatuses 10. When each apparatus 10 is adjusted to a locked position, operators may safely work below load 12. After the required work has been completed each apparatus 10 may be adjusted to an unlocked position enabling further movement of load 12.

In some embodiments the suspended load may comprise a load 12 supported by a movable lumber bin floor 14. As shown in FIGS. 1A-1C, bin floor 14 may be used, for example, in a lumber sorting apparatus. In one embodiment bin floor 14 repeatedly travels in a reciprocating fashion between a raised lumber loading position and a lowered lumber discharge position. In the raised lumber loading position the lumber sorting apparatus delivers lengths of lumber into the bin which is supported on bin floor 14. Hydraulic actuators progressively lower the bin floor 14 relative to sorter cable(s) to enable loading of additional lengths of lumber into the bin, resulting in a substantial load supported by bin floor 14. When the bin floor 14 is fully lowered to the discharge position the bin may be "plumb full" of lumber. At the discharge position the lumber may be delivered onto a conveyer or some other discharge location for further processing. The bin floor 14 may comprise a plurality of inclined, spaced-apart load support members 15 to facilitate loading and discharge of lumber. After the lumber has been discharged from the bin the hydraulic actuators then raise the bin floor 14 to the fully raised lumber loading position and the cycle is repeated.

Occasionally it is necessary for lumber mill operators to stop the movement of a lumber bin part-way between the fully raised lumber loading position and the lowered discharge position. For example, a length of lumber may become misaligned or stuck on the discharge conveyor. In such circumstances the lumber mill operator may need to move underneath bin floor 14 in order to remedy the problem, such as by manually removing or realigning a length of lumber which is askew. Since bin floor 14 may be supporting a very substantial suspended load as discussed above, it is critical that the bin floor 14 be locked in a fixed position preventing downward travel of floor 14 until it is safe to restart the sorting apparatus for further lumber processing. In particular, occupational safety regulations in some jurisdictions require that a suspended load must be mechanically locked prior to any work underneath the load rather than relying only on a hydraulic system to maintain the load in position.

Locking apparatus 10 is designed to releasably lock bin floor 14 or any other suspended load at a desired position. In the lumber mill embodiment of FIGS. 1A-1C a pair of locking apparatuses 10 are provided, each mounted to an end portion of bin floor 14. As shown best in FIGS. 1A and 1C, the lumber sorting apparatus may be designed or modified to include a restraint cable 16 aligned with each locking apparatus 10 which extends vertically between the fully raised lumber loading location at the top of the sorting apparatus and the lumber discharge location at the bottom of the sorting apparatus. At its upper end cable 16 is anchored to the frame of the sorting apparatus using a suitable fitting, such as an anchor bracket equipped with a swaged-on-ferrule that fits through the top anchor bracket. The lower end of cable 16 may be similarly secured to the sorting apparatus frame at the bottom of the sorting apparatus. Each cable 16 is independent of the other sorter cables and hydraulic actuators and is typically installed at an end portion of the bin where it will not interfere with lumber loading and unloading. Bin floor 14 includes an aperture to receive cable 16 and to enable bin floor 14 to travel up and down relative to cable 16 which remains fixed in position. In some embodiments each bin may comprise a pair of restraint cables 16 mounted at opposite ends of the bin and floor 14 may comprise a corresponding pair of apertures. In some embodiments cable 16 may be approximately 0.75-1.5 inches in diameter. In one particular embodiment cable 16 is 1 inch in diameter. In some embodiments cable 16 may be an IWRC 6×26 steel cable having good resistance to wear and abrasion.

Figure 2A:
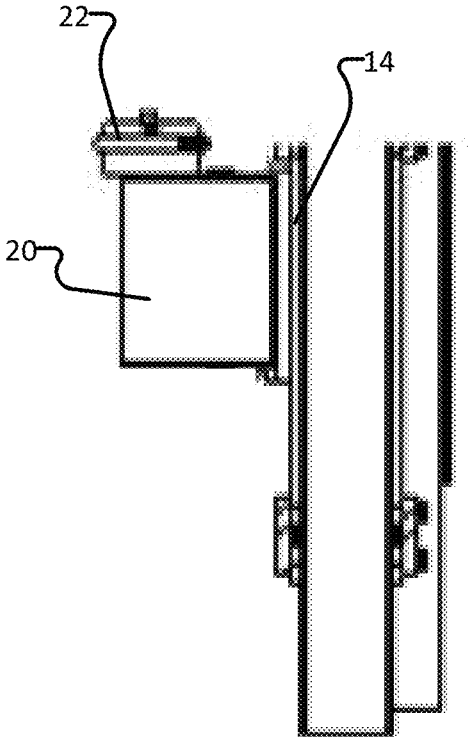
FIG. 2A is an enlarged side elevational view of a locking apparatus mounted on the bin floor.

Apparatus 10 is designed to be securely mounted at an end portion of bin floor 14 proximate cable 16, such as by welding. FIGS. 2A and 2B show an embodiment of a mount for mounting apparatus 10 on bin floor 14. As described in detail below, cable 16 is threaded through apparatus 10. In an unlocked, release position apparatus 10 travels up and down with bin floor 14 relative to cable 16. In a locked position, apparatus 10 securely engages cable 16 thereby preventing further potentially unsafe downward movement of bin floor 14 and any load 12 which it supports.

Figure 3:
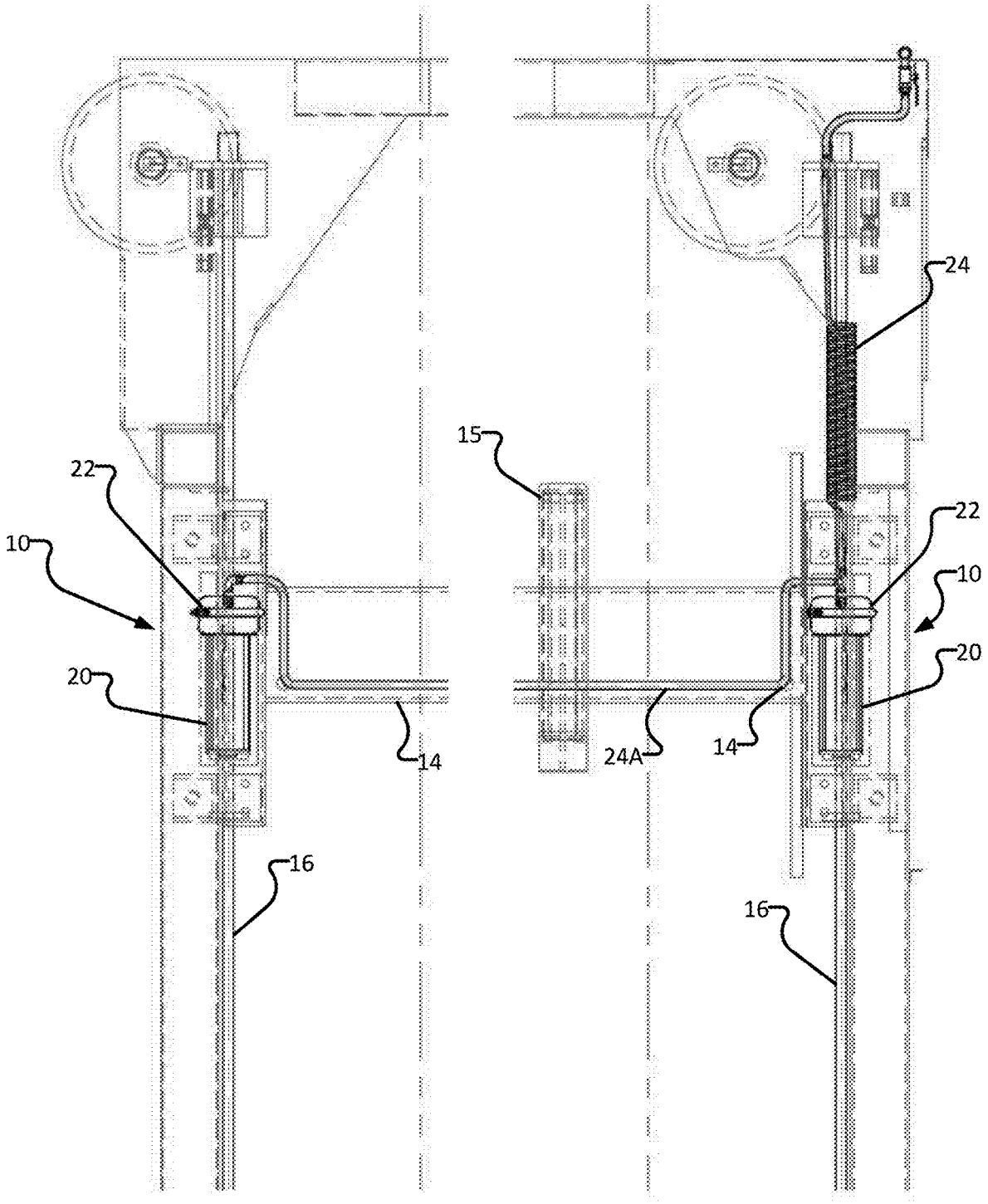
FIG. 3 is an enlarged, partially fragmented front view of the locking system of FIGS. 1A-1C showing each locking apparatus installed on an end portion of the lumber bin floor.

Apparatus 10 includes a housing 20 and an actuator 22 coupled to housing 20. In some embodiments actuator 22 may comprise a commercially available pneumatic brake actuator, such as an air brake actuator manufactured by Haldex Brake Products Corp. designed for use with semi-trailer trucks. Such actuators 22 are reliable, inexpensive and built to withstand the elements in harsh environmental conditions. As shown in FIG. 3, actuator 22 receives an air supply from a coiled air supply hose 24 connectable to the air supply header of the sorting apparatus (not shown). The air supply hose 24 extends and retracts as bin floor 14 and locking apparatus 10, including actuator 22, is lowered and raised in reciprocating cycles. A supplementary air supply hose 24A may also be provided for delivering air to actuator 22 of locking apparatus 10 mounted on the other end of bin floor 14 (i.e. air supply hose 24A extends from the "lumber line" to the "clear line" side of the lumber sorting apparatus).

Figure 4A:
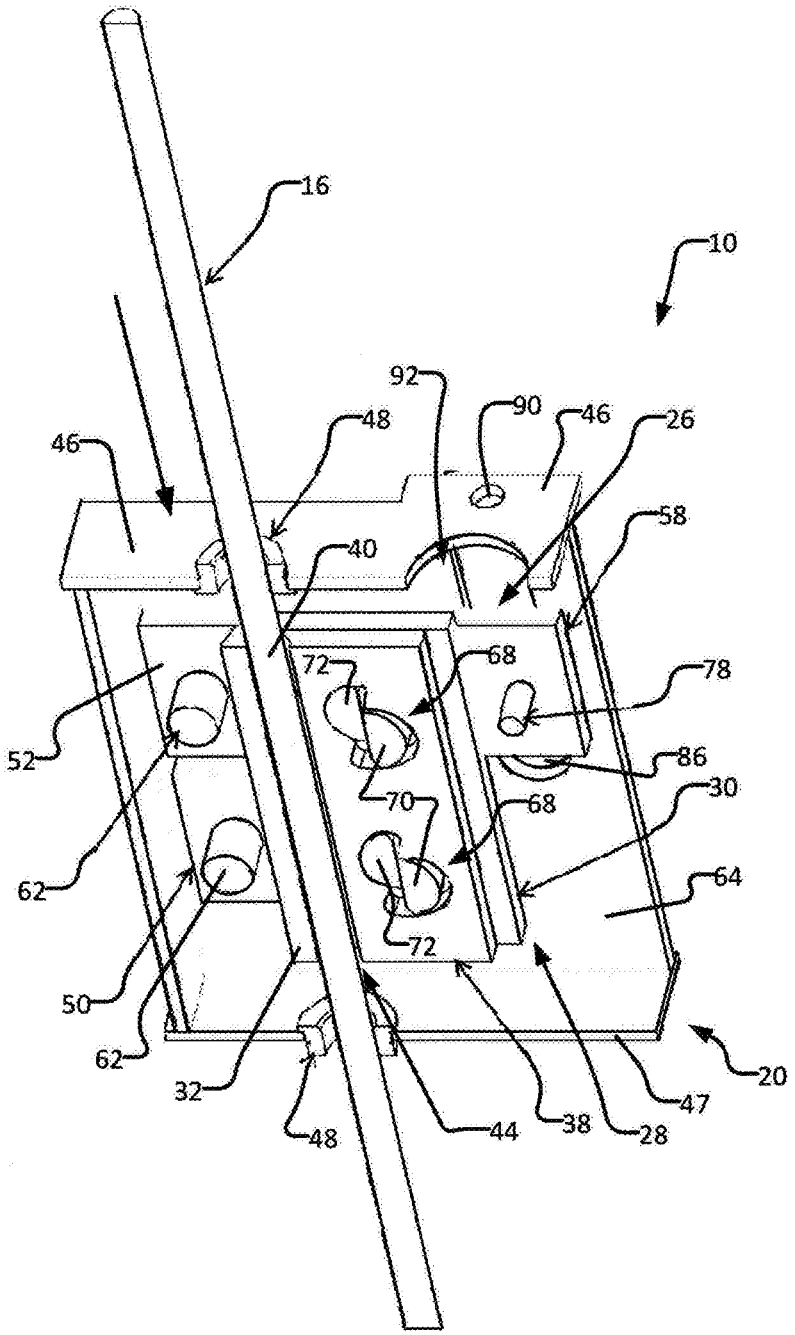
FIG. 4A is an enlarged, longitudinal sectional view of a locking apparatus and length of cable showing the internal clamping assembly.
Figure 4B:
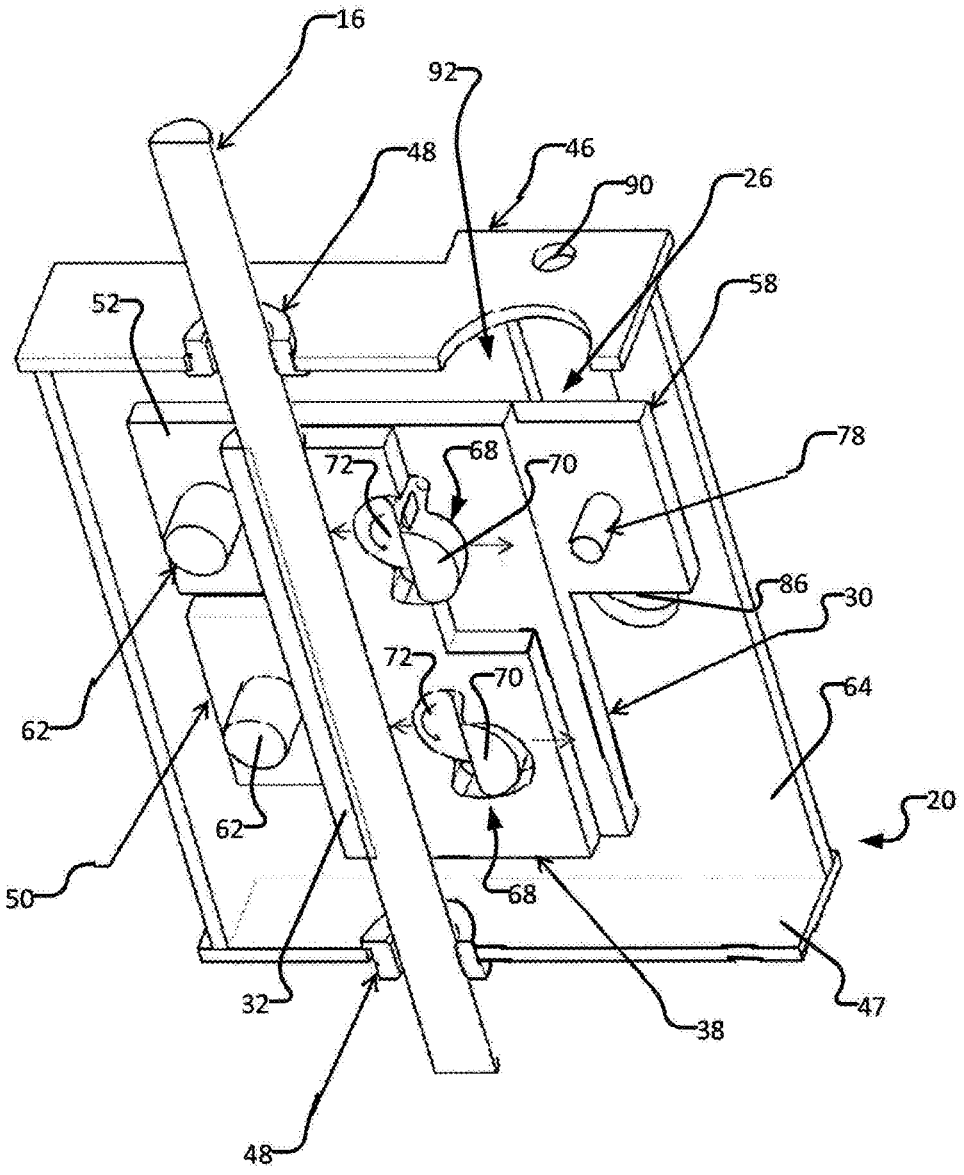
FIG. 4B is a further enlarged, longitudinal sectional view thereof showing the clamp of the clamping assembly partially broken-away.

FIGS. 4A and 4B are sectional views illustrating an internal air-activated clamping assembly 26 mounted within housing 20 of locking apparatus 10 for releasably engaging a cable 16 (in these figures actuator 22 is not shown). As described in detail below, clamping assembly 26 is adjustable between a locked position engaging fixed cable 16 and a release position enabling apparatus 10 to travel relative to cable 16. In the embodiment of these figures cable 16 extends in a vertical orientation. However, in other embodiments cable 16 may extend in a horizontal orientation, or an angled orientation between a vertical and a horizontal orientation.

Figure 5:
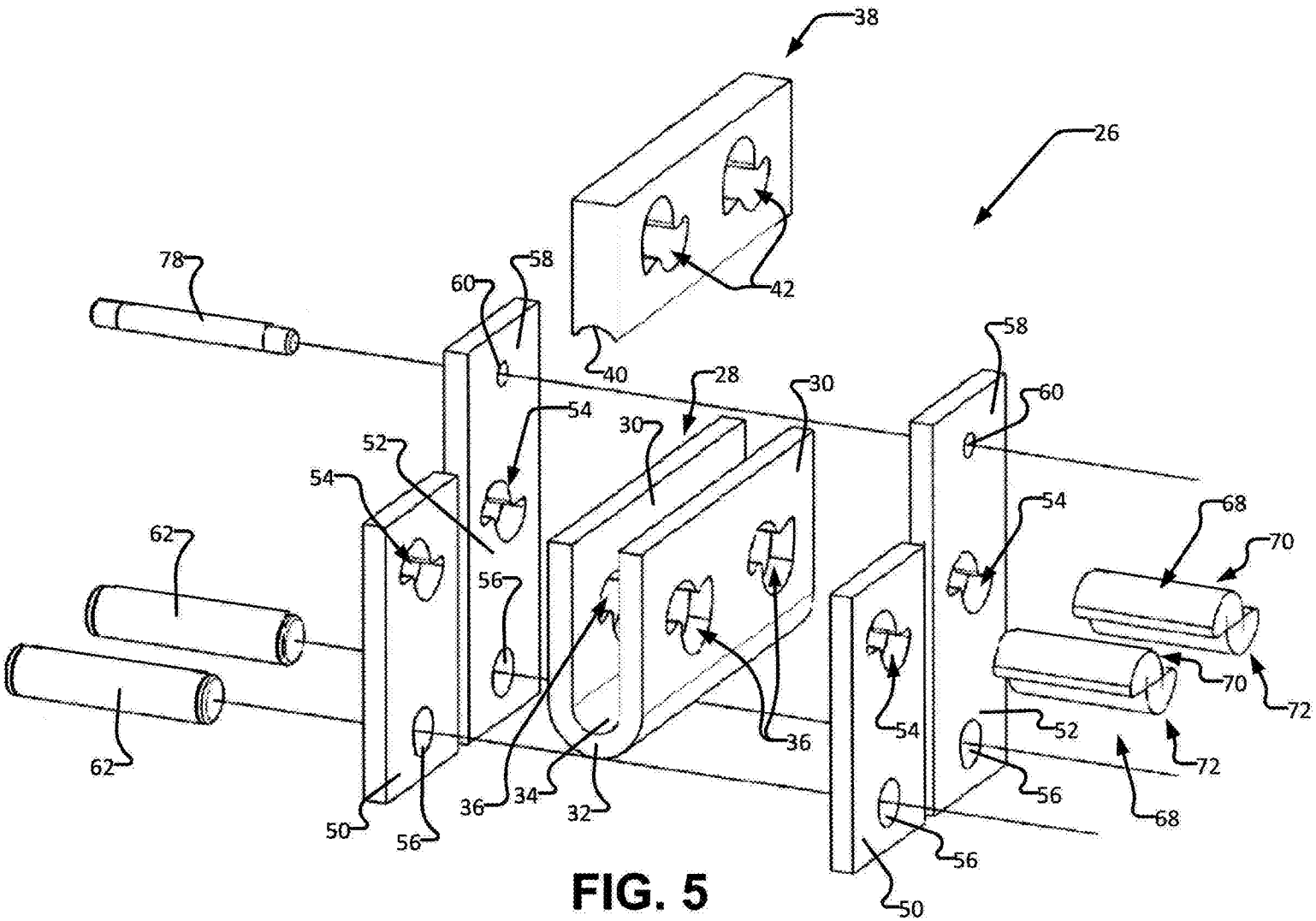
FIG. 5 is an exploded isometric view of components of the clamping assembly.
Figure 9A:
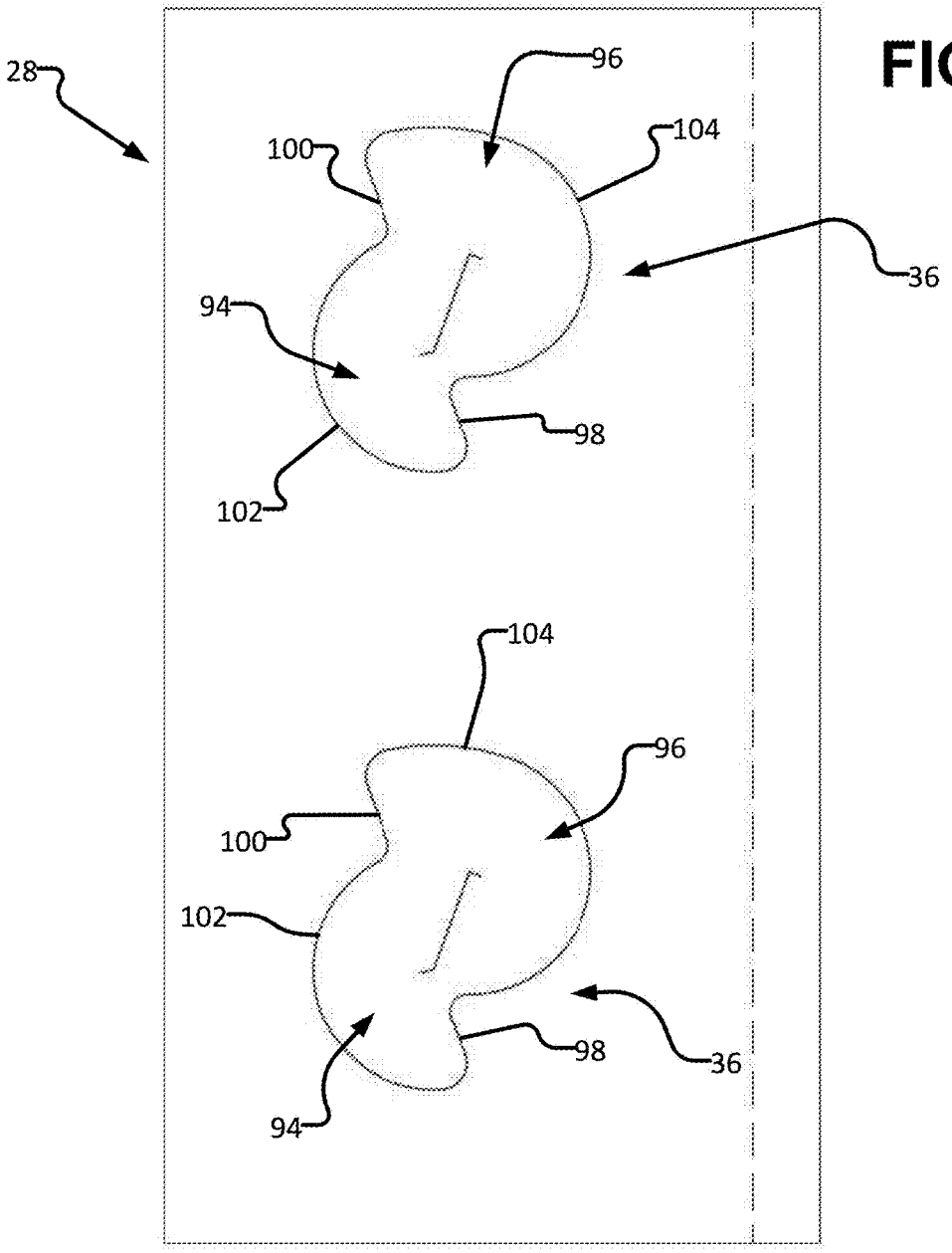
FIG. 9A is an enlarged side elevational view of a shoe of the clamping assembly.
Figure 9B:
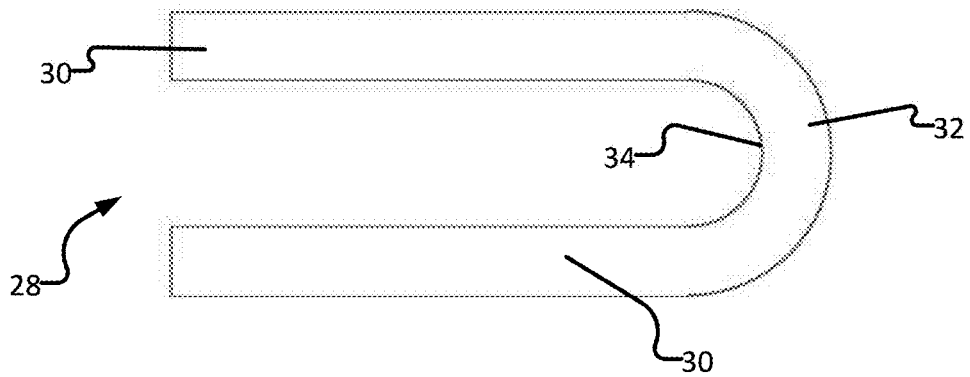
FIG. 9B is an end elevational view thereof.

FIG. 5 is an exploded view illustrating the clamping assembly 26 mounted within housing 20 and connectable to actuator 22. Assembly 26 includes a U-shaped shoe 28 comprising spaced-apart first and second side plates 30 joined at one end by a curved bottom portion 32 (FIGS. 9A-9B). Bottom portion 32 defines a curved inwardly concave lower surface 34 within the interior of shoe 28. Each side plate 30 includes a pair of spaced-apart apertures 36 shaped as described below. Apertures 36 of respective side plates 30 are in alignment.

Figure 7:
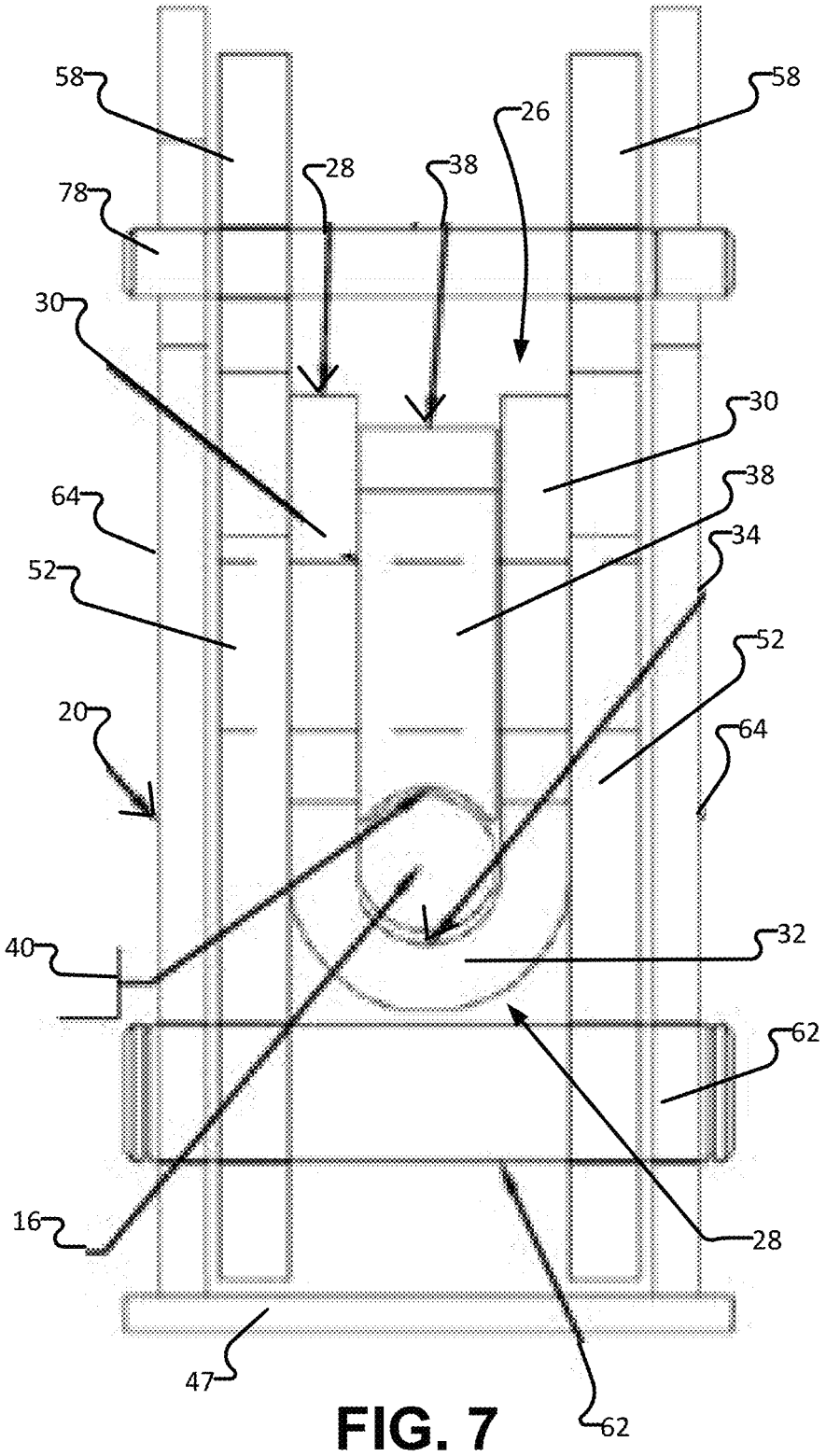
FIG. 7 is an enlarged end view of the clamping assembly mounted within the housing of the locking apparatus.
Figure 10A:
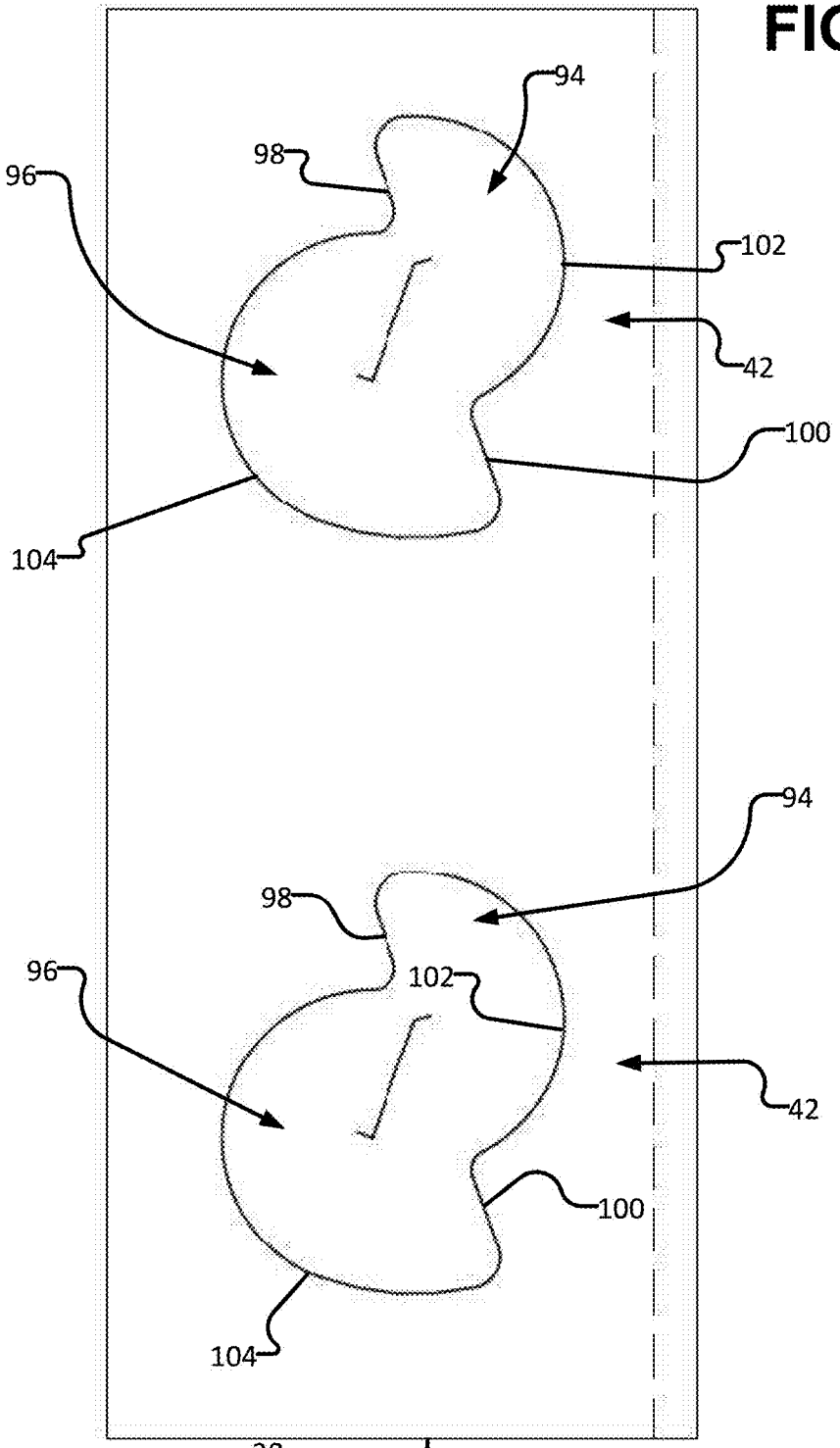
FIG. 10A is an enlarged side elevational view of a clamp of the clamping assembly.
Figure 10B:
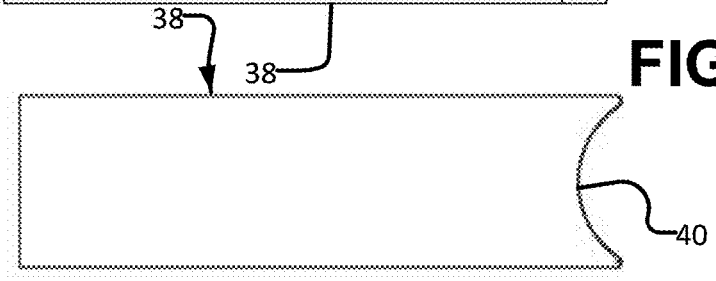
FIG. 10B is an end elevational view thereof.

Assembly 26 further includes a clamp 38 which is positionable within shoe 28 between first and second side plates 30. Clamp 38 includes an inwardly concave surface 40 (FIGS. 10B and 7). A pair of spaced-apart apertures 42 extend through clamp 38. As discussed further below, in some embodiments clamp apertures 42 have the same generally "S" shape and size as shoe apertures 36 but have a reverse or "flipped" orientation.

When clamp 38 is assembled within shoe 28 apertures 36, 42 are partially aligned and curved surfaces 34, 40 together define a cylindrical conduit 44 for receiving cable 16. As shown for example in FIGS. 4A, 4B, 7, 14 and 17A-17C, housing 20 includes end panels 46 and 47 having cable guides 48 formed therein in alignment with conduit 44 for receiving cable 16. As discussed further below, in an unlocked, released position conduit 44 is sufficiently large for cable 16 to pass freely through clamping assembly 26 within housing 20. In a locked, engaged position curved clamping surfaces 34, 40 engage cable 16 for securing apparatus 10 (and hence bin floor 14 and any supported load 12) to cable 16.

In some embodiments clamping assembly 26 further includes a pair of first lever arms 50 and a pair of second lever arms 52 (FIGS. 5 and 11-14). Each first lever arm 50 includes a cam pin aperture 54 and a connecting pin aperture 56. Each second lever arm 52 similarly includes a cam pin aperture 54 and a connecting pin aperture 56. In the illustrated embodiment each second lever arm 52 is longer than each first lever arm 50 and includes an extended portion 58 having a pivot pin aperture 60 formed therein.

As shown best in FIG. 7, shoe 28 is disposed between each pair of first lever arms 50 and similarly between each pair of second lever arms 52. Each pair of first lever arms 50 is coupled together below shoe 28 with a connecting pin 62 which is received within aligned pin apertures 56. Each pair of second lever arms 52 is similarly coupled together below shoe 28 with a connecting pin 62 which is received within aligned apertures 56. As shown in FIG. 8A, housing 20 includes side panels 64 having connecting pin apertures 66 formed therein for receiving respective connecting pins 62 to couple lever arms 50, 52 to housing 20 when apertures 56,66 are aligned during assembly.

Figure 6A:
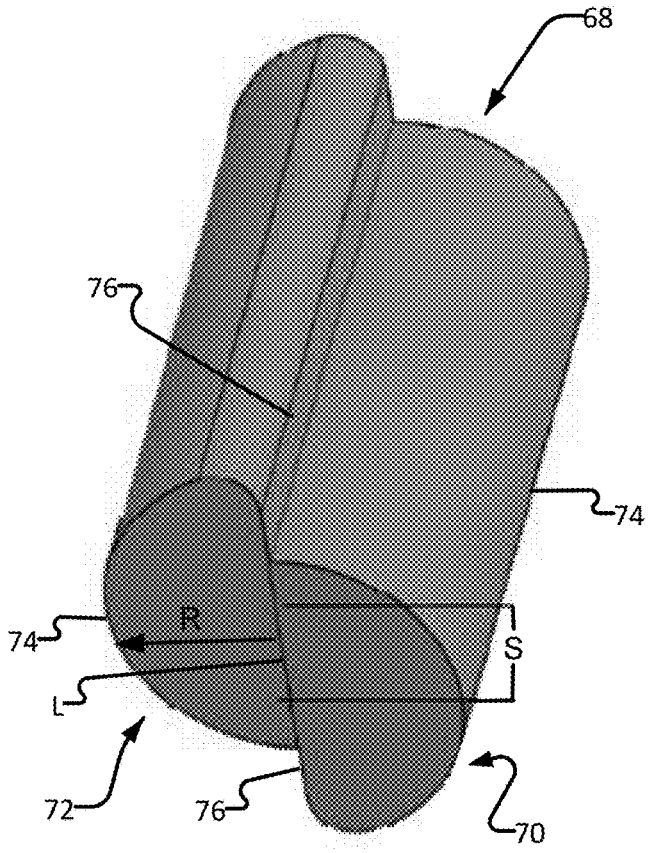
FIG. 6A is an enlarged isometric view of a cam pin of the clamping assembly showing a first example of center-to-center spacing of the two half-round portions.
Figure 6B:
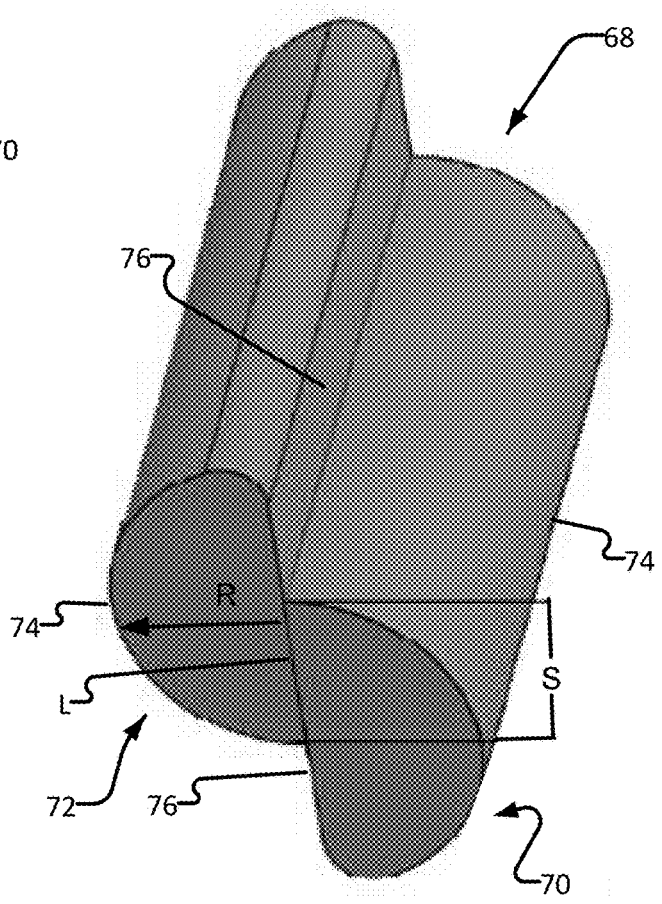
FIG. 6B is an enlarged isometric view of a cam pin of the clamping assembly showing a second example of center-to-center spacing of the two half-round portions.
Figure 6C:
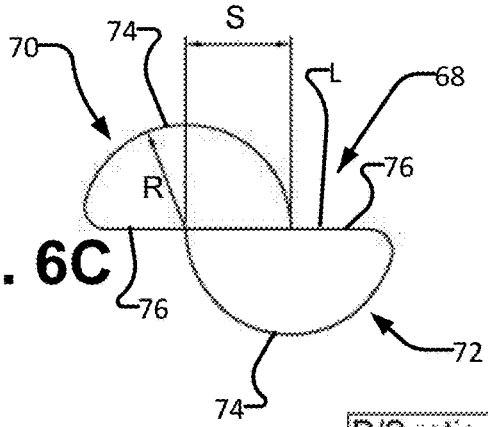
FIG. 6C is an end elevational view of an embodiment of a cam pin of the clamping assembly having a D/S ratio of 2.
Figure 6G:
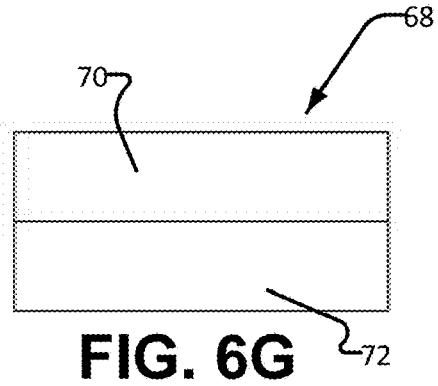
FIG. 6G is a side elevational view of the cam pin of FIGS. 6C-6F.
Figure 6D:
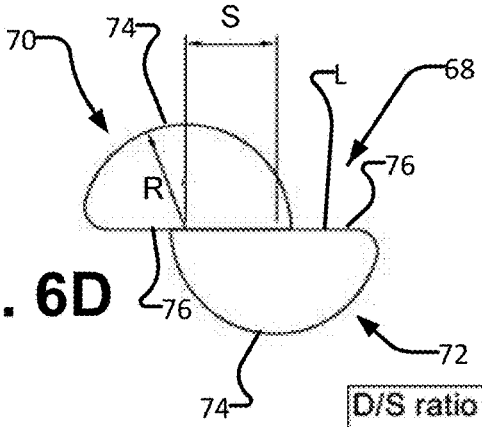
FIG. 6D is an end elevational view of an embodiment of a cam pin of the clamping assembly having a D/S ratio of 2.3.
Figure 6E:
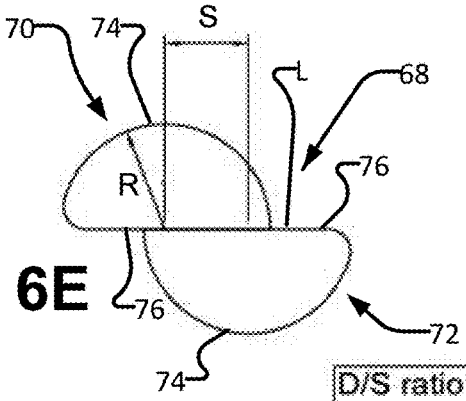
FIG. 6E is an end elevational view of an embodiment of a cam pin of the clamping assembly having a D/S ratio of 2.5.
Figure 6F:
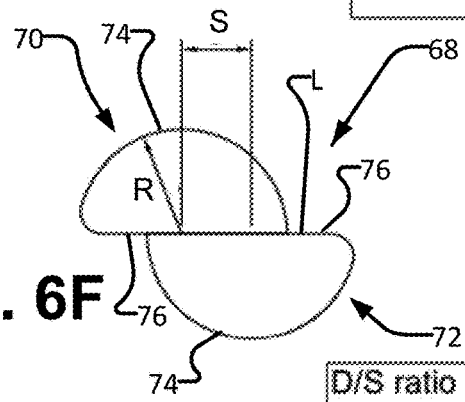
FIG. 6F is an end elevational view of an embodiment of a cam pin of the clamping assembly having a D/S ratio of 3.

Clamping assembly 26 further includes a pair of cam pins 68 each having a first half-round portion 70 and a second half-round portion 72 (FIGS. 5 and 6A-6G). Half-round portions 70, 72 are laterally spaced apart to define a spacing S between their respective centers as measured along a diametral center line L (FIGS. 6A-6F). First half-round portion 70 has a radius R and comprises an outer curved surface 74 extending in an arc and a flat surface 76 extending laterally of second half-round portion 72. Second half-round portion 72 similarly comprises a radius R and an outer curved surface 74 extending in an arc and a flat surface 76 extending laterally of first half-round portion 70. As described further below, FIG. 6A illustrates an embodiment with a first center-to-center spacing S and FIG. 6B illustrates an embodiment with a second spacing S larger than the first spacing S. FIGS. 6C-6F similarly illustrate in end elevational views embodiments having different center-to-center spacing.

Figure 11:
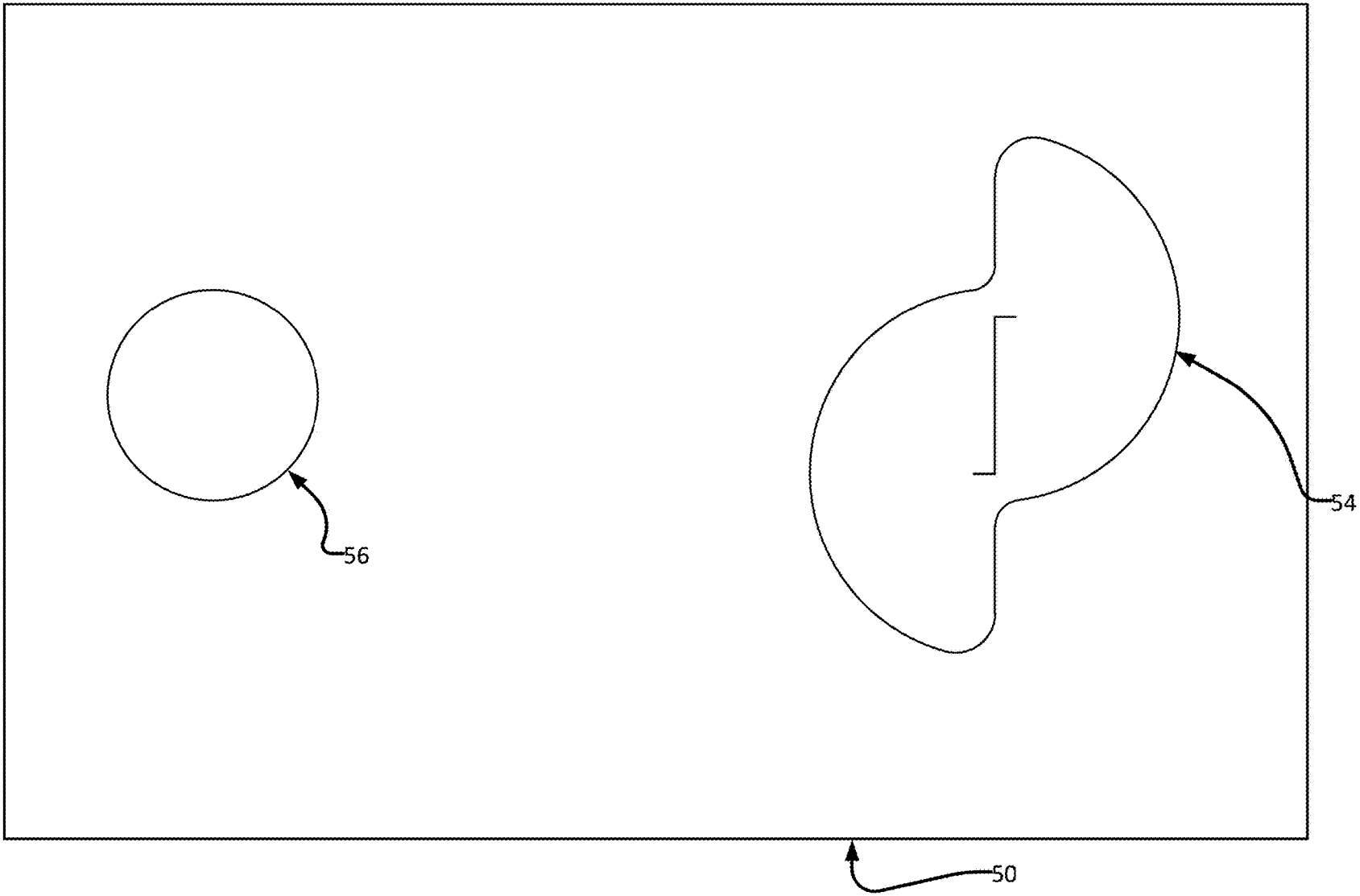
FIG. 11 is a side elevational view of a first lever arm of the clamping assembly.
Figure 12:
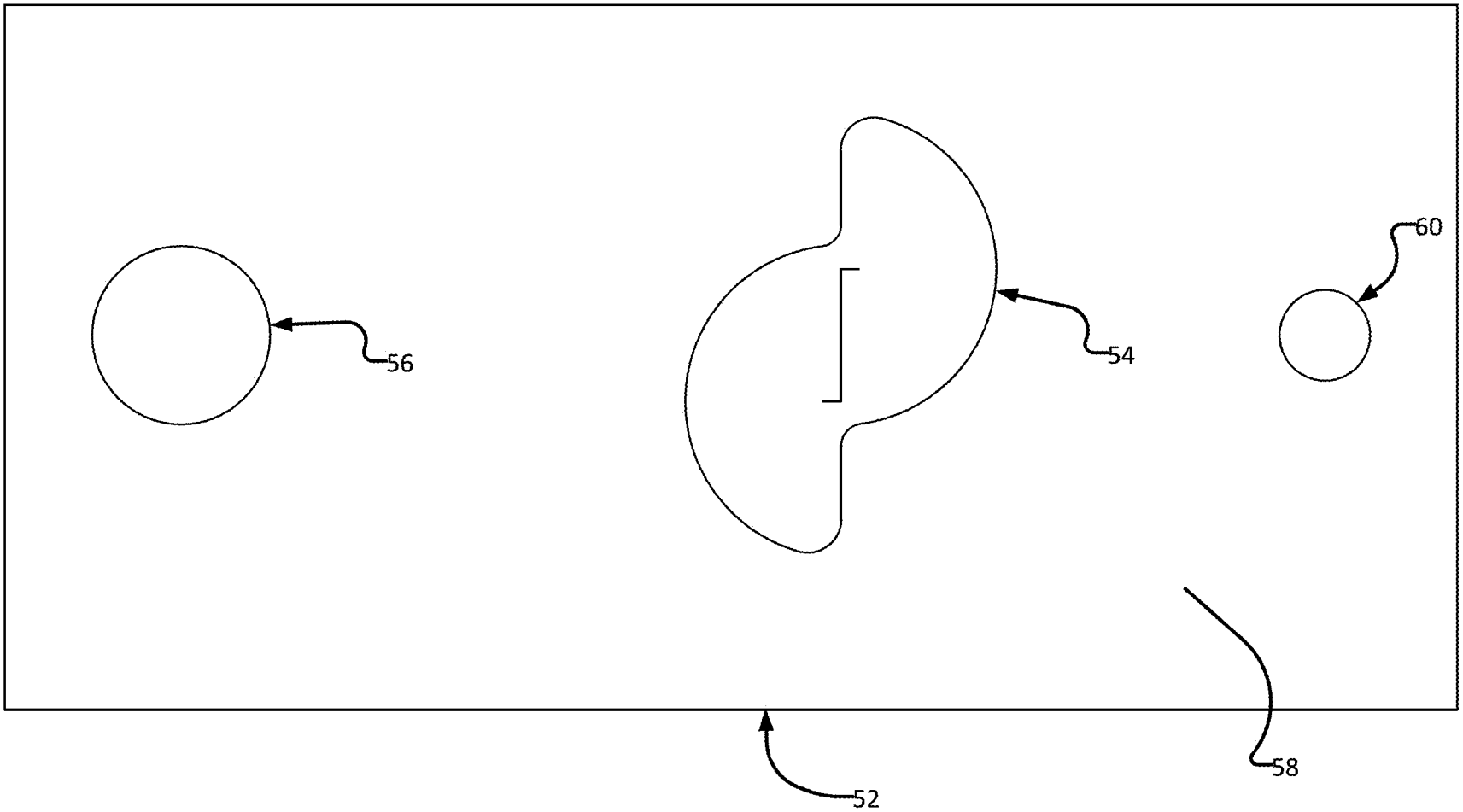
FIG. 12 is a side elevational view of a second lever arm of the clamping assembly.
Figure 13:
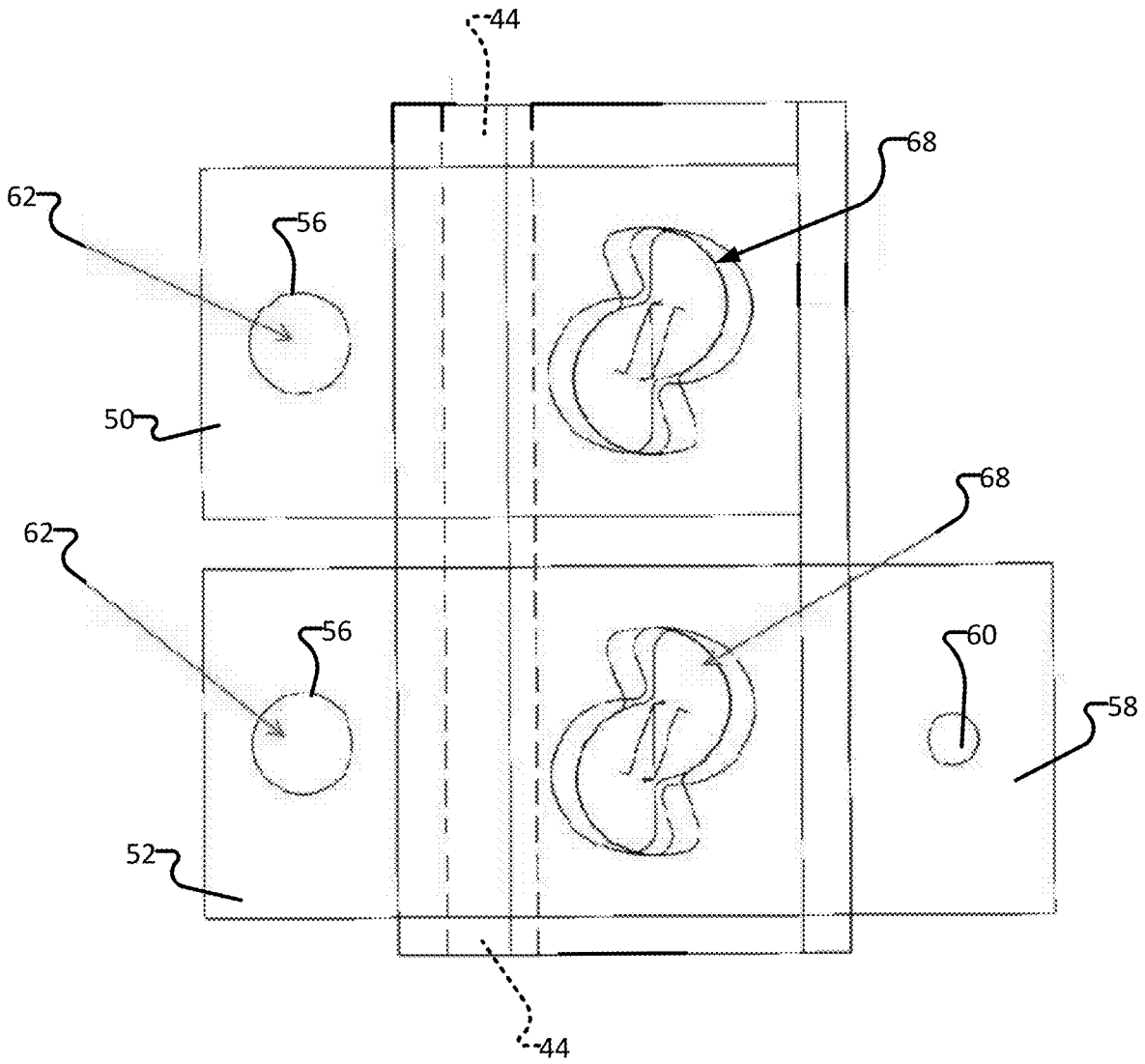
FIG. 13 is a side elevational view of a partially assembled clamping assembly.

As shown in FIGS. 5 and 13, one cam pin 68 is insertable through aligned apertures 54 of first lever arm 50 and corresponding apertures 36, 42 of shoe 28 and clamp 38. The other cam pin 68 is insertable through aligned apertures 54 of second lever arm 52 and corresponding apertures 36, 42 of shoe 28 and clamp 38. The size and shape of apertures 54 closely matches the size and shape of cam pins 68 (FIGS. 11 and 12). Thus, as discussed further below, rotation of lever arms 50, 52 relative to housing 20 about pins 62 causes corresponding rotational motion of cam pins 68.

Figures 17A, 17B, 17C:
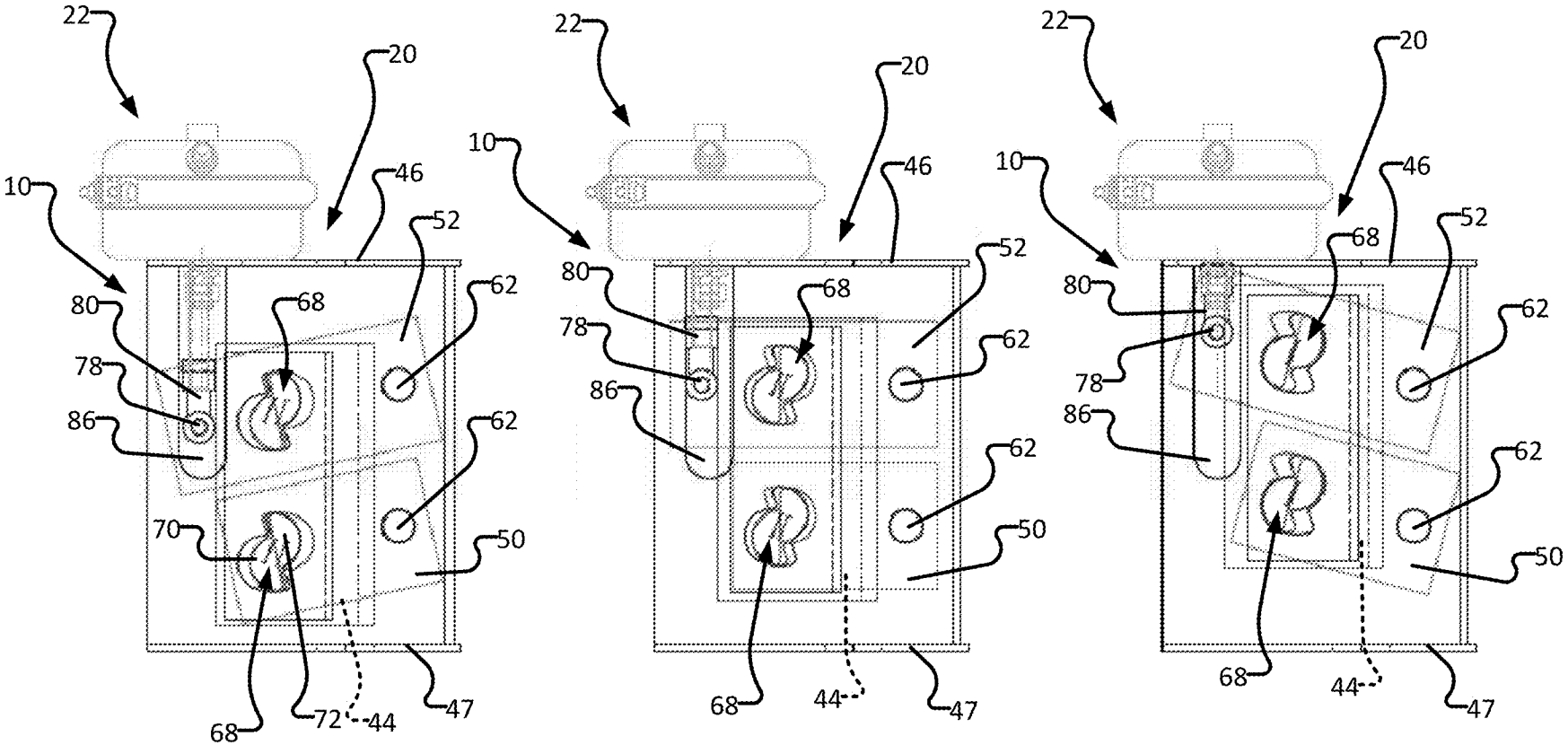
FIG. 17A is a side view of a locking apparatus comprising an actuator mounted on a housing and having a side panel of the housing removed to showing the locking apparatus in a release position.
FIG. 17B is a side view thereof showing the locking apparatus in an intermediate/activated position.
FIG. 17C is a side view thereof showing the locking apparatus in a fully clamped position.

In some embodiments rotation of lever arms 50, 52 is controlled by coupling second lever arms 52 to actuator 22 with a pivot pin 78. More particularly, pivot pin 78 is passed through connecting pin apertures 60 formed in the extended portion 58 of each second lever arm 52. One end of pivot pin 78 is coupled to a reciprocating shaft 80 connected to a spring mounted within actuator 22 (FIGS. 17A-17C). Compression of the spring is driven by an air-activated rubber piston. That is, when air is provided to actuator 22 under pressure this causes a diaphragm to compress the spring and extend shaft 80 into the interior of housing 20 (FIG. 17A). When the air supply is shut off and the air pressure is bled this enables the spring to expand against the diaphragm, causing shaft 80 to retract from housing 20 into actuator 22 (FIG. 17B). As will be appreciated by a person skilled in the art, many other means for controllably actuating reciprocating movement of shaft 80 can be envisioned.

As shown for example in FIGS. 8A, 17A-17C, 20A-20C, in some embodiments housing 20 may include an aperture 86 formed in a side panel 64 of housing 20. Aperture 86 is provided for ease of assembly of apparatus 10, for example to facilitate mounting of actuator 22 to end plate 46 and coupling of pivot pin 78 to the end of actuator shaft 80. Aperture 86 also provides a window for viewing the position of pivot pin 78 and shaft 80 within the interior of housing 20 during operation of apparatus 10. Since shaft 80 is connected to pivot pin 78, this in turn causes rotation of lever arms 50, 52 which move in parallel relative to housing 20 about pins 62. In some embodiments shaft 80 may have a stroke length of approximately 2.5-3.0 inches.

Figure 8B:
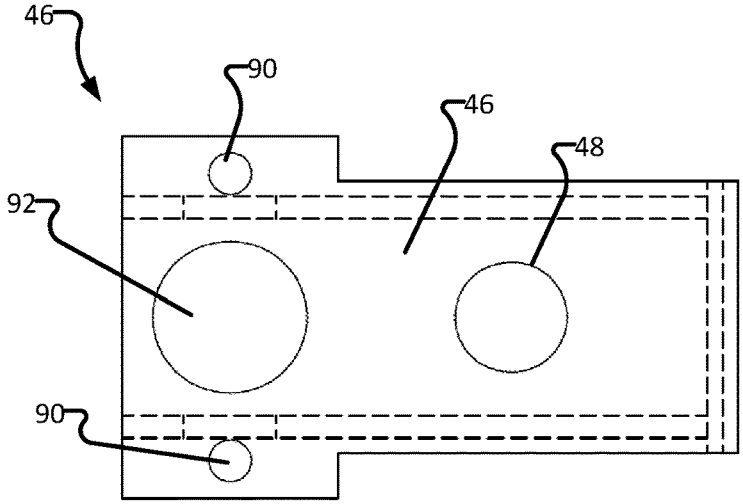
FIG. 8B is a top plan view of thereof.
Figure 8D:
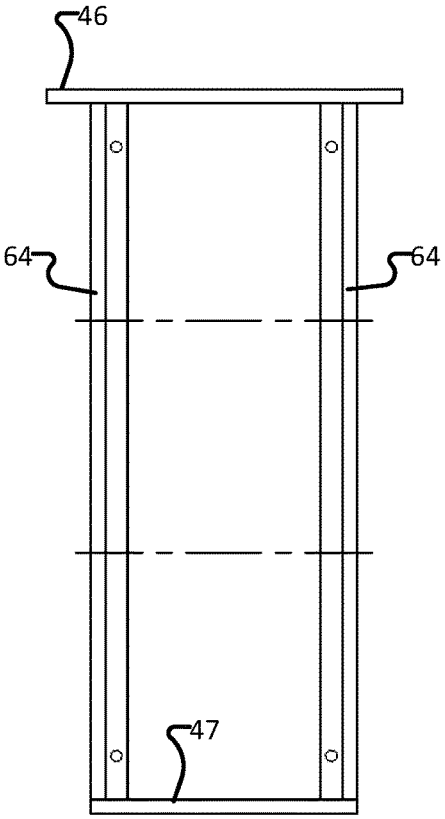
FIG. 8D is an end elevational view thereof.
Figure 8A:
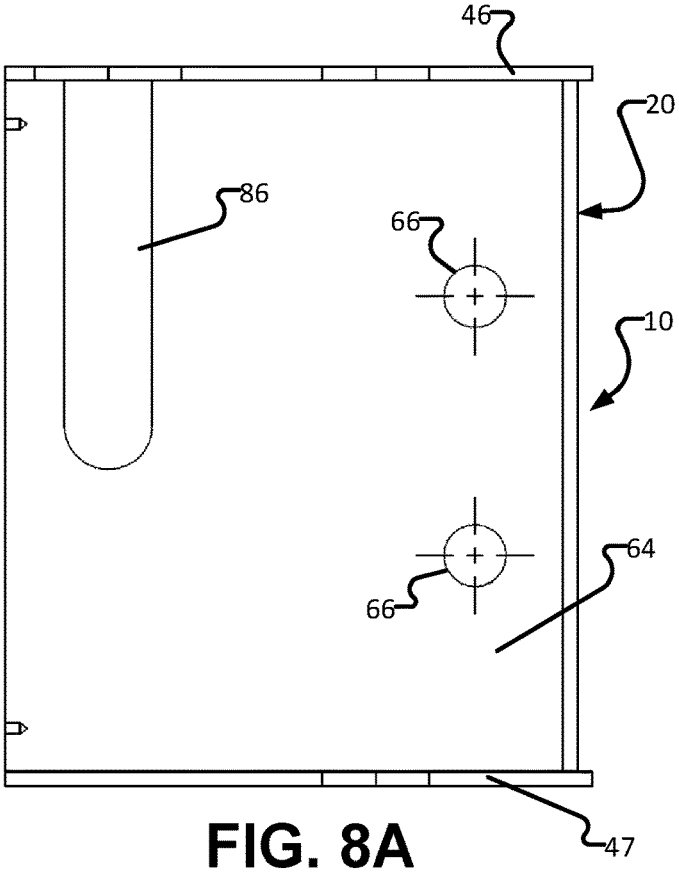
FIG. 8A is a front view of locking apparatus housing.
Figure 8C:
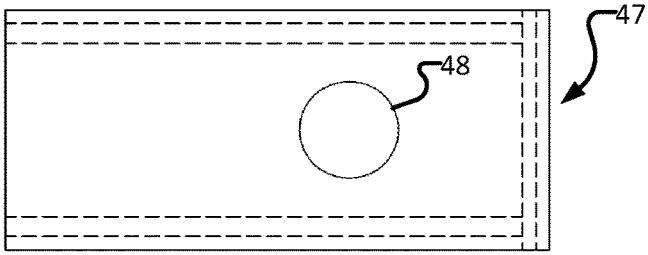
FIG. 8C is a bottom plan view thereof.

Actuator 22 is mounted on housing 20 by means of fasteners secured to apertures 90 formed in a flanged portion of end plate 46 (FIG. 8B). End plate 46 includes an aperture 92 enabling insertion of shaft 80 and other internal components of actuator 22 into the interior of housing 20.

As shown best in FIGS. 9A and 10A and FIGS. 18A-19C, apertures 36 of shoe 28 and apertures 42 of clamp 38 are the same size but are disposed in reverse orientations. In particular, each aperture 36 includes a relatively small portion 94 and a relatively large portion 96 which are laterally offset. At the juncture between aperture portions 94, 96 planar surfaces 98 and 100 are defined. Each relatively small portion 94 comprises a curved wall surface 102 extending between planar surfaces 98, 100. Each relatively large portion 96 similarly comprises a curved wall surface 104 extending between planar surfaces 98, 100. In the orientation of FIG. 5, relatively small portion 94 forms the upper part and relatively large portion 96 forms the lower part of each aperture 36 of shoe 28. In clamp 38 the orientation is reversed, namely relatively small portion 94 forms the lower part and relatively large portion 96 forms the upper part of each clamp aperture 42. As will be apparent to a person skilled in the art from the drawings, in use shoe 28 and clamp 38 may be deployed in an orientation different from FIG. 5 but the relative positioning and reverse orientations of apertures 36 and 42 is maintained.

Relatively small aperture portion 94 is sized to tightly receive a half-round portion 70 or 72 of a cam pin 68. That is, the radius of aperture curved wall 102 closely matches the radius R of each half-round portion 70, 72. Relatively large aperture 96 is sized to accommodate rotation of a half-round portion 70 or 72 of a cam pin 68.

In operation, apparatus 10 is maintained in an unlocked, released configuration during normal operation when compressed air is supplied to actuator 22. In this configuration shaft 80 of actuator 22 maintains lever arms 50, 52 in the position shown in FIG. 17A. In this configuration curved surfaces 34 and 40 of shoe 28 and clamp 38 are spaced-apart from cable 16. This enables apparatus 10 to travel relative to cable 16 as described above, for example as lumber bin floor 14 vertically reciprocates between loading and unloading/discharging positions.

Figure 14:
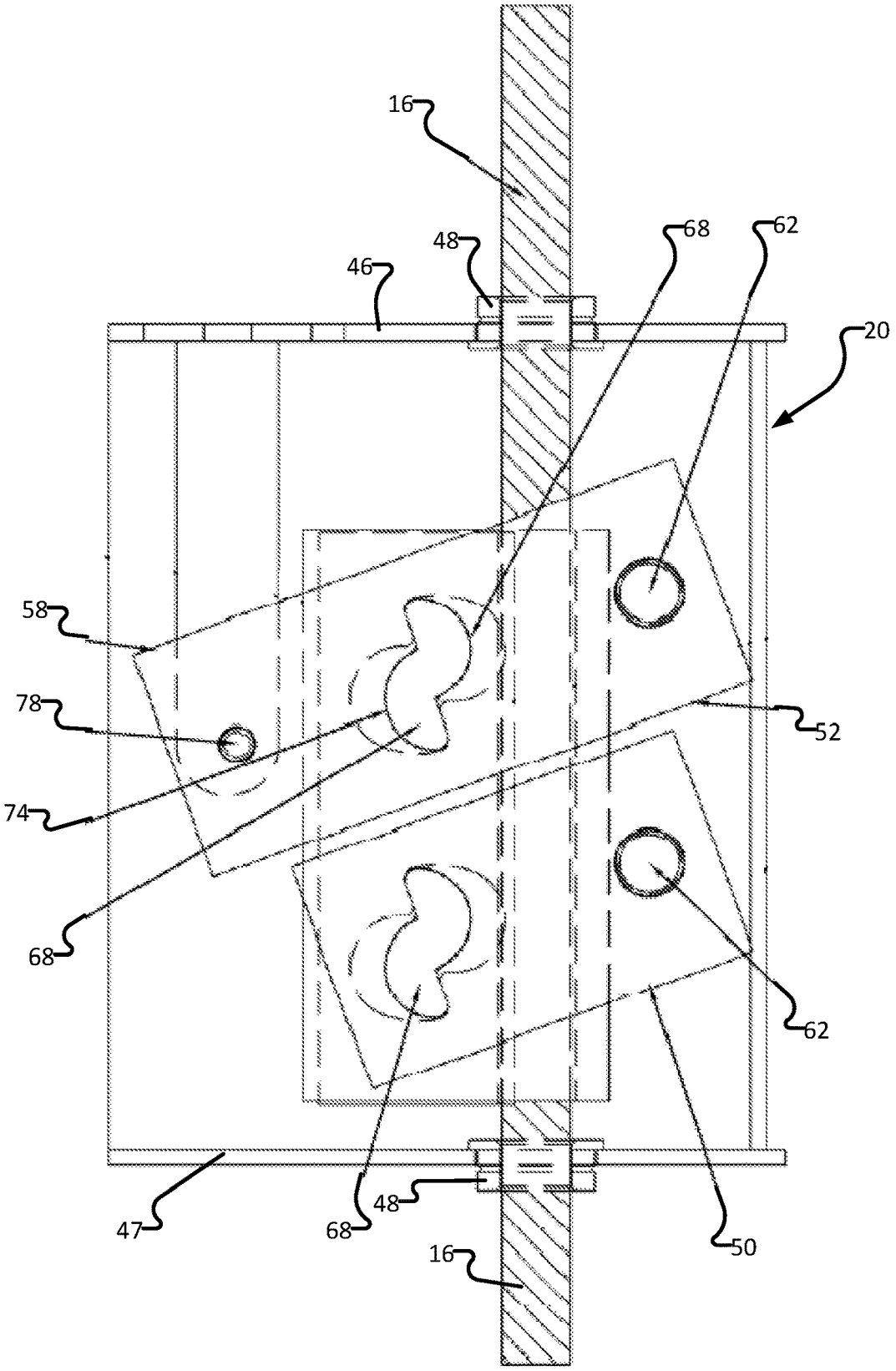
FIG. 14 is an enlarged side view partially in section showing an assembled clamping assembly mounted within the interior of a housing for engaging a cable.
Figure 15:
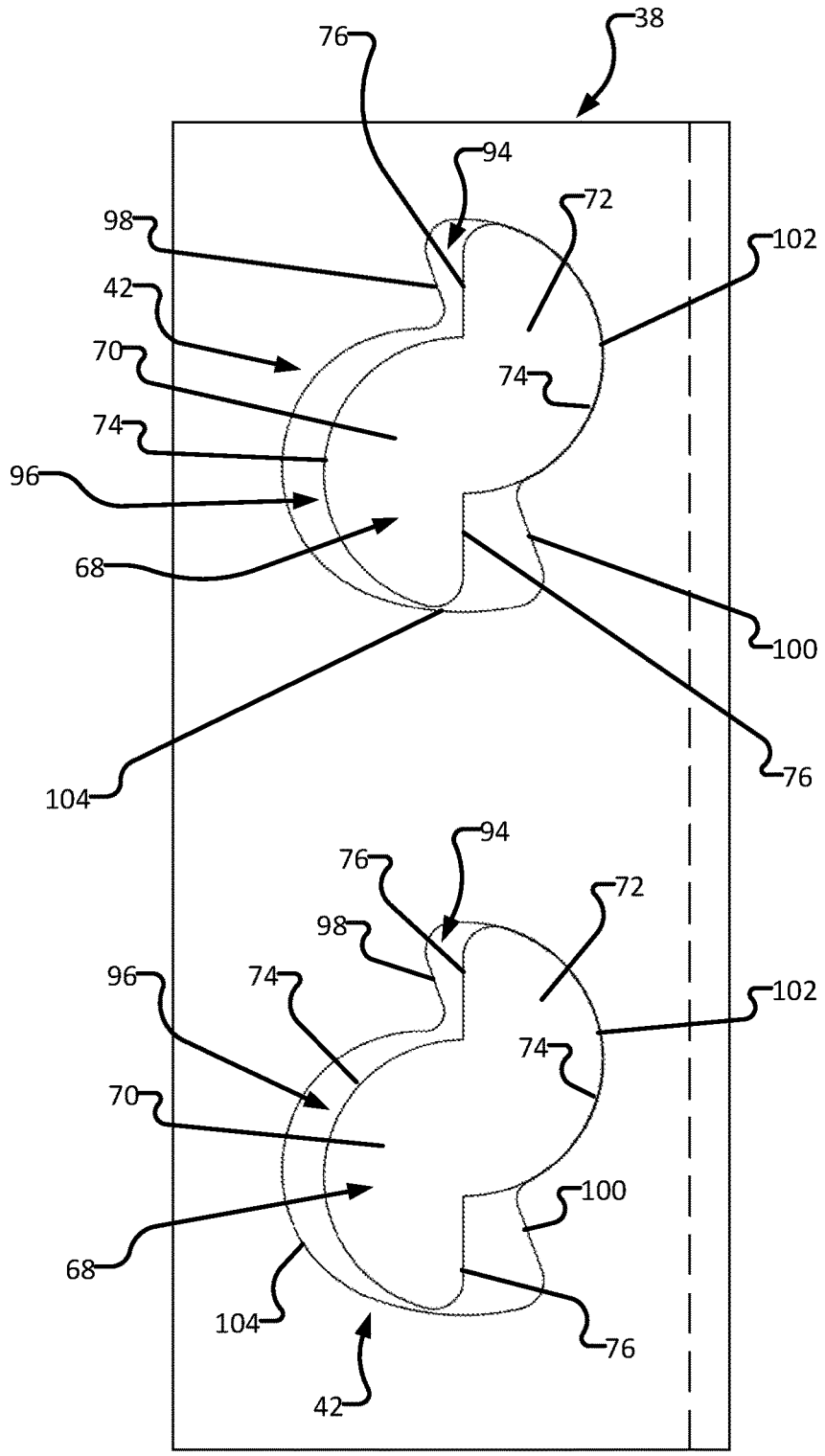
FIG. 15 is an enlarged side view of a clamp receiving a cam pin in an intermediate/activated rotational position.
Figure 16:
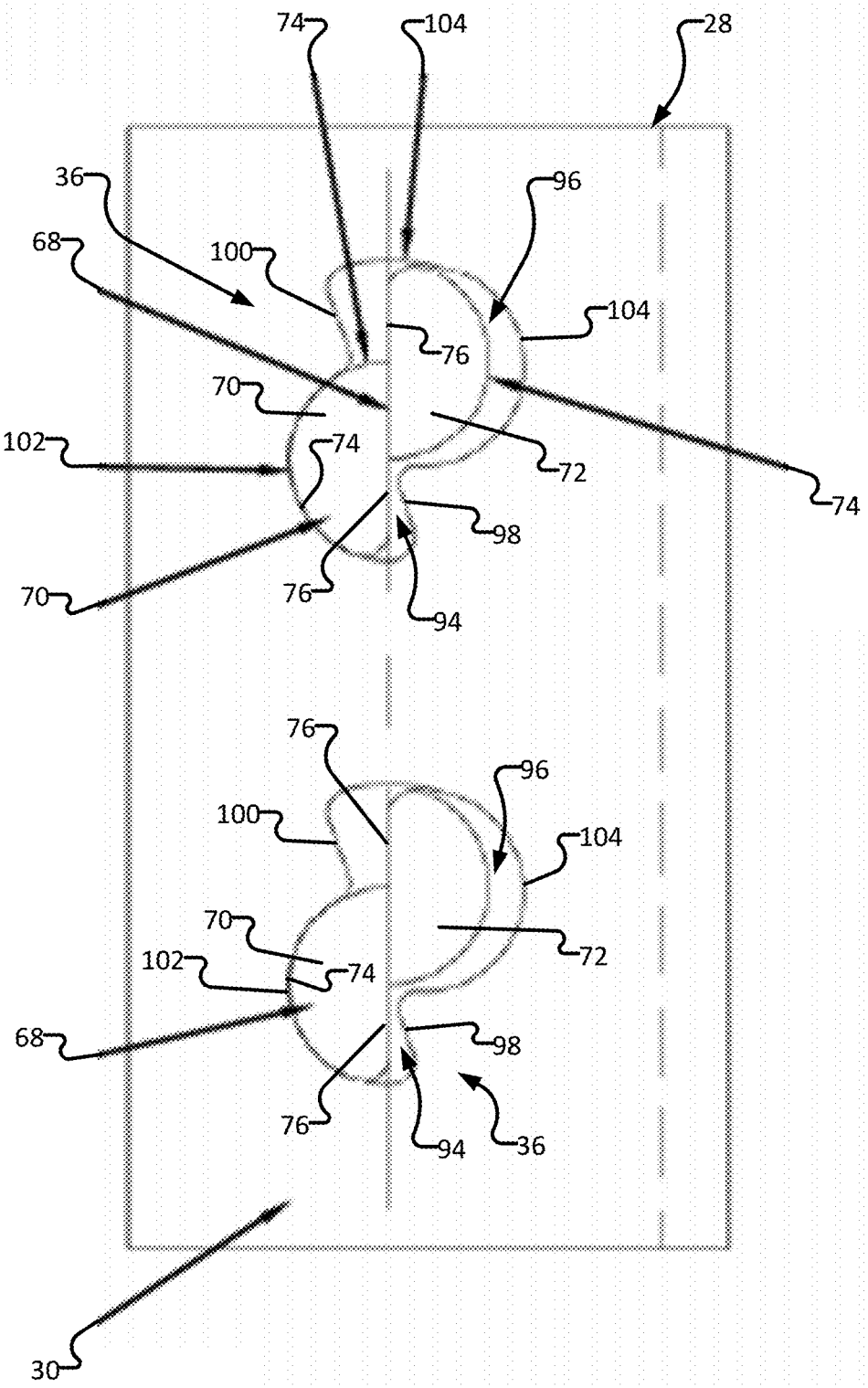
FIG. 16 is an enlarged side view of a shoe receiving a cam pin in the intermediate/activated position of FIG. 15.

When the compressed air supply to actuator 22 is shut-off and the air pressure is bled to atmosphere this enables the actuator spring to expand, causing shaft 80 to retract within actuator 22 as described above (FIG. 17B). Since pivot pin 78 is coupled to the end of shaft 80, linear retraction of shaft 80 causes pivoting motion of lever arm 52 as well as lever arm 50 which moves in parallel to lever arm 52. Pivoting motion of lever arms 50, 52 in turn causes rotation of each cam pin 68 which fits tightly within apertures 54 formed within respective lever arms 50, 52 (FIG. 14). Rotation of cam pins 68 within aligned apertures 36, 42 of shoe 28 and clamp 38 applies a clamping force thereto, causing curved surfaces 34 and 40 to move together in a linear direction generally perpendicular to the longitudinal axis of cable 16. Thus the shut-off and bleeding of the air supply to actuator 22 causes clamping assembly 26 to close the cable conduit 44 from the release position shown in FIG. 17A to the intermediate/activated clamping position of FIG. 17B where curved clamping surfaces 34, 40 engage clamp 16.

In the intermediate/activated position of FIG. 17B, wherein clamping assembly 26 engages cable 16, any further traction force between cable 16 and clamping assembly 26 will cause shoe 28 and clamp 38 to engage cable 16 more tightly in a self-gripping fashion. For example, a downward force in the direction of the arrow in FIGS. 4A and 20A caused by movement of load 12 supported by bin floor 14 relative to cable 16 will cause further rotation of levers arms 50, 52 from the intermediate/activated position of FIG. 17B toward the fully clamped position shown in FIG. 17C. This in turn will cause further rotation of cam pins 68 and hence an increase in the self-gripping clamping force applied to cable 16. Thus the greater the load 12 supported by bin floor 14 which is transferred to locking apparatus 10, the more clamping force is applied to cable 16 to safely lock floor 14 at the desired location.

Figure 20A:
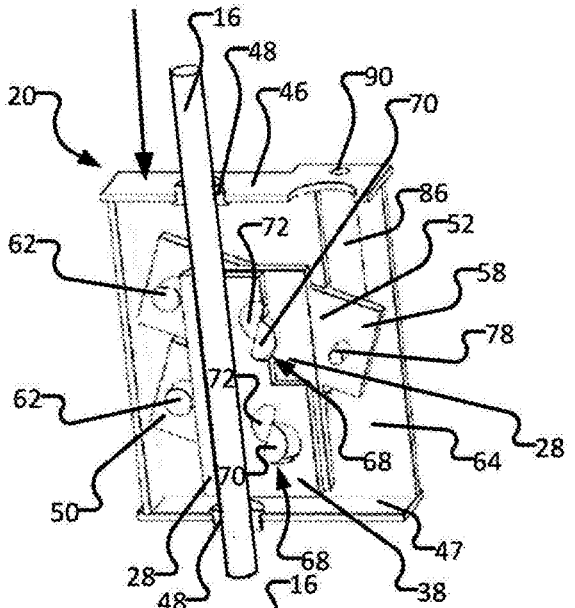
FIG. 20A is a longitudinal sectional view of a locking apparatus and a length of cable showing the apparatus in a release position.
Figure 20B:
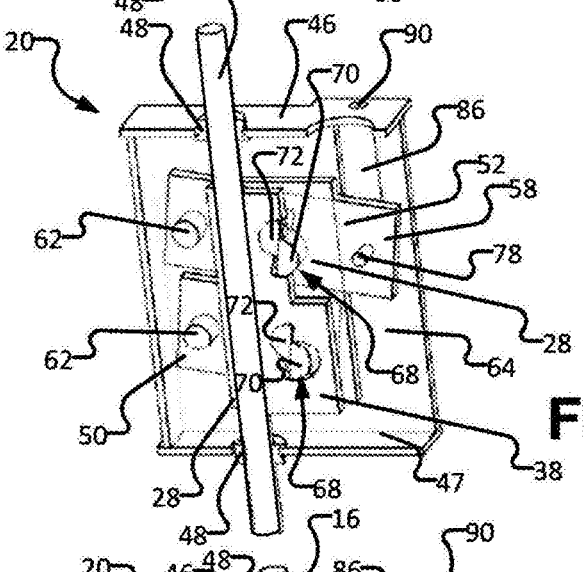
FIG. 20B is a longitudinal sectional view thereof in an intermediate/activated position.
Figure 20C:
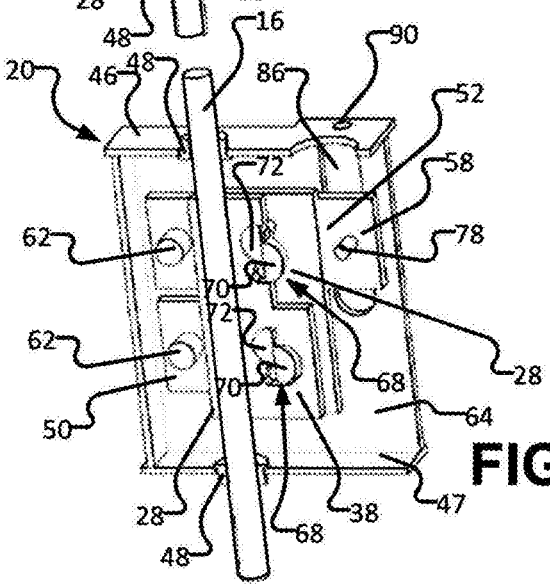
FIG. 20C is a longitudinal sectional view thereof in a clamped position.

In ordinary operation bin floor 14 is at least partially maintained in the desired suspended location by the operation of the sorting apparatus support cables and hydraulic system and each apparatus 10 will not mechanically support the entire load 12 carried by floor 14. However, in some instances, for example due to small leaks in the hydraulic system and/or extreme ambient temperatures, floor 14 and its supported load 12 may drift or "creep" downwardly thereby causing clamping assembly 26 to engage cable 16 more tightly as described above. FIG. 20C shows an embodiment where apparatus 10 is in a locked position wherein clamping assembly 26 is engaging cable 16 but a maximum clamping force is not being applied, for example where load 12 and bin floor 14 is at least partially supported by the sorting apparatus hydraulic system. FIG. 17C shows an embodiment where apparatus 10 is in a locked position wherein clamping assembly 26 is engaging cable 16 and a maximum clamping force is being applied, for example due to a complete failure of the sorting apparatus hydraulic system.

Figure 18A:
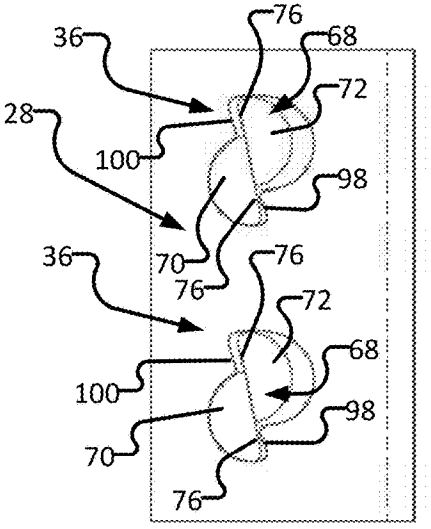
FIG. 18A is a side view of the shoe and cam pins in the release position.
Figure 18B:
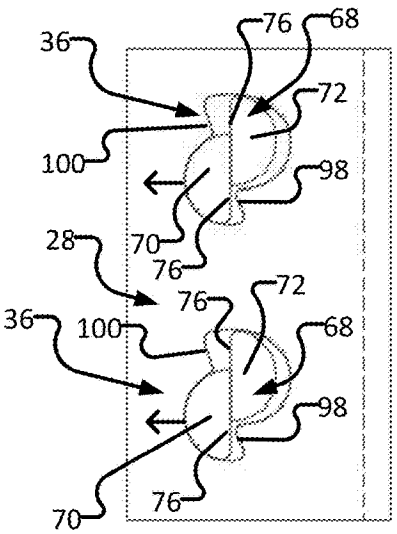
FIG. 18B is a side view thereof in the intermediate/activated position.
Figure 18C:
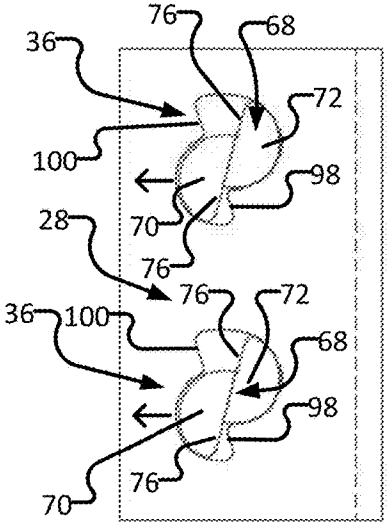
FIG. 18C is a side view thereof in the fully clamped position.
Figure 19A:
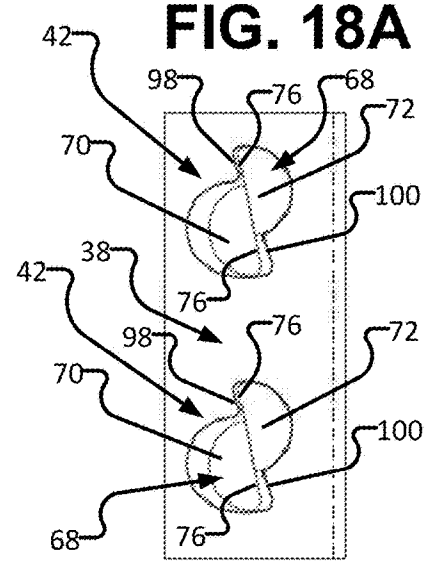
FIG. 19A is a side view of the clamp and cam pins in the release position.
Figure 19B:
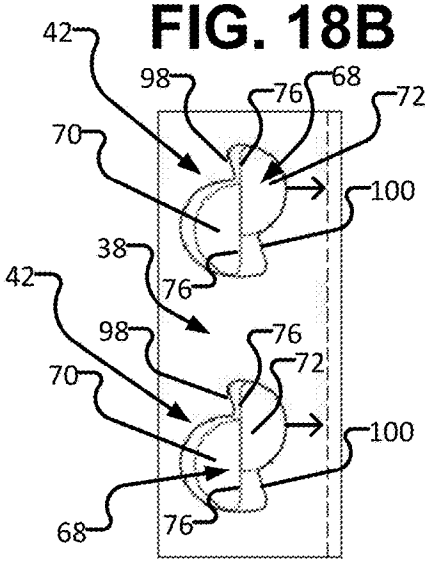
FIG. 19B is a side view thereof in the intermediate/activated position.
Figure 19C:
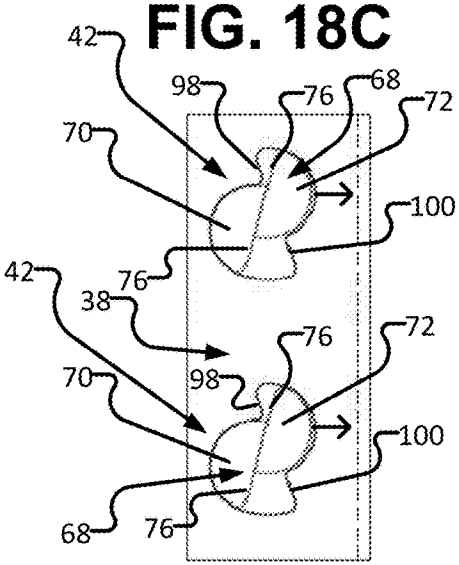
FIG. 19C is a side view thereof in the fully clamped position.

FIGS. 18A-C show in isolation the position of cam pins 68 relative to apertures 36 formed in shoes 28 in the release, intermediate/activated and fully clamped positions respectively. FIGS. 19A-C similarly show in isolation the position of cam pins 68 relative to apertures 42 formed in clamps 38 in the release, intermediate/activated and fully clamped positions respectively. As discussed above, apertures 36, 42 are partially aligned (FIGS. 5, 13 and 17A-17C) to enable cam pins 68 to extend therethrough transversely within housing 20. With reference to FIG. 18A, in the release position first portion 70 of each cam pin 68 is located within relatively smaller portion 94 of each aperture 36 and second portion 72 of each cam pin 68 is located within relatively larger portion 96 of each aperture 36. In this release position flat portion 76 of cam first portion 70 contacts surface 98 of aperture 36 (FIG. 9A) to constrain rotational movement of cam pin 68 in one direction (in a counterclockwise direction in the orientation of FIG. 18A) which in turn actively pushes shoe 28 away from cable 16 to maximize the spacing between curved surface 34 and cable 16. With reference to FIG. 19A, in the release position second portion 72 of each cam pin 68 is located within relatively smaller portion 94 of each aperture 42 and first portion 70 of each cam pin 68 is located within relatively larger portion 96 of each aperture 42. In this release position flat portion 76 of cam first portion 72 contacts surface 98 of aperture 42 (FIG. 10A) to constrain rotational movement of cam pin 68 in one direction (in a counterclockwise direction in the orientation of FIG. 19A) which in turn pushes clamp 38 away from cable 16 to maximize the spacing between curved surface 40 and cable 16. Since the spacing between respective surfaces 34, 40 and cable 16 is at a maximum in the release position, the diameter of cable conduit 44 is at its maximum size (FIG. 17A). Thus in the position of FIGS. 18A/19A clamping assembly 26 is fully open and cable conduit 44 is maintained at its maximum diameter by the action of actuator 22. This enables housing 20 to travel relative to cable 16 as described above.

When the air supply to actuator 22 is shut-off and the air pressure is bled to atmosphere as described above this causes adjustment of clamping assembly 26 from the release position to the intermediate/activated position of FIGS. 18B/19B, resulting in the rotation of cam pins 68 relative to the longitudinal axis thereof (in a clockwise direction in the orientation of FIGS. 18A-18C, 19A-19C). With reference to FIG. 18B, the aforesaid rotational movement causes the application of a linear force in the direction of the arrows by means of the engagement of curved surface 74 of first cam portion 70 against the adjacent wall 102 of relatively smaller portion 94 of each aperture 36. With reference to clamp 38, the aforesaid rotational movement similarly causes the application of a linear force in the opposite direction, as shown by the arrows of FIG. 19B, by means of the engagement curved surface 74 of second cam portion 72 against the adjacent wall 102 of relatively smaller portion 94 of each aperture 42. Thus the force applied by the rotation of cam pins 68 causes movement of the curved portion 34 of shoe 28 in a first direction toward cable 16 and simultaneously causes movement of the curved portion 40 of clamp 38 in the opposite direction toward cable 16. In the intermediate/activated position of FIGS. 18B/19B clamping assembly 26 is thus now engaging cable 16.

As discussed above, in some embodiments housing 20 may be coupled to a load 12, such as a load of lumber supported on a lumber bin floor 14. As housing 20 securely engages the fixed cable 16, the load 12 may be exert a force on housing 20. For example, as described above, hydraulic "creep" or complete failure of the sorting apparatus hydraulic system and sorter support cables may cause the application of a downward force on housing 20, e.g. in the direction of the arrows shown in FIGS. 4A and 20A. Any further relative movement of housing 20 and cable 16 will cause lever arms 50, 52 to pivot further toward the fully clamped position shown in FIG. 17C. For example, housing 20 may slide downwardly relative to cable 16 if gravitational forces exceed the upwardly directed forces applied by the sorting apparatus hydraulic system. Any further pivoting motion of lever arms 50, 52 causes clamping assembly 26 to engage cable 16 more tightly. As shown in FIG. 17C, further relative movement of housing 20 and cable 16 resulting in further pivoting motion of lever arms 50, 52 causes further rotation of cam pins 68 relative to the longitudinal axis thereof (in a clockwise direction in the orientation of FIGS. 17A-17C). This causes cam pin 68 to move from the activated/intermediate position of FIG. 17B toward the fully clamped position of FIG. 17C. With reference to FIG. 18C, the aforesaid rotational movement causes the application of a further linear force in the direction of the arrow by means of the further forceful engagement of curved surface 74 of first cam portion 70 against the adjacent wall 102 of relatively smaller portion 94 of each aperture 36. With reference to clamp 38, the aforesaid rotational movement similarly causes the application of a linear force in the opposite direction, as shown by the arrows of FIG. 19C, by means of the engagement curved surface 74 of first cam portion 72 against the adjacent wall 102 of relatively smaller portion 94 of each aperture 36. Thus the force applied by the further rotation of each cam pin 68 causes further movement of the curved portion 34 of shoe 28 in a first direction toward cable 16 and simultaneously causes movement of the curved portion 40 of clamp 38 in the opposite direction toward cable 16. In the position of FIGS. 18C/19C clamping assembly 26 is now fully engaging cable 16 and load 12 supported by bin floor 14 is safely immobilized. For example, even if the hydraulic system controlling movement of lumber bin floor 14 fails entirely as discussed above and the entire load 12 supported by bin floor 14 is transferred to locking apparatuses 10, the position of floor 14 and accompanying load 12 will remain mechanically locked at the desired location, preventing further downward travel of floor 14 and accompanying load 12.

After any desired work beneath bin floor 14 and any accompanying load 12 is completed, each apparatus 10 may be adjusted from the locked position to the unlocked position by reconnecting the air supply to apply air pressure to actuator 22 of each apparatus 10. If there is any slack in the sorting apparatus support cables, for example due to creep in the hydraulics as discussed above, the hydraulic system of the lumber sorting apparatus may be used to raise bin floor 14 relative to cable 16 prior to reactivating the air supply. As will be apparent to a person skilled in the art, in the embodiment of a lumber sorting apparatus described above employing a vertical restraint cable 16 clamping assembly 26 allows bin floor 14 to move up relative to cable 16 from a clamped position, but not down relative to cable 16. Upward movement of bin floor 14 from the locked position transfers load 12 from restraint cable 16 to the sorter support cable(s) or other mechanical structures supporting controlled movement of bin floor 14. Apparatus 10 may then be adjusted to the release position by reactivating the air supply to actuator 22, thereby once again enabling travel of bin floor 14, load 12 and apparatus 10 relative to cable 16 during normal operation of the lumber sorting apparatus.

As explained above, problems can arise with the clamping mechanism if cable 16 and/or curved clamping surfaces 34, 40 of shoe 28 and clamp 38 engaging cable 16 begin to wear or are otherwise damaged. This will increase the amount of stroke required by the actuator 22 to allow the cable 16 to come in contact with curved clamping surfaces 34, 40 of and allow the above-described self-gripping action. This wear will reduce the clamping force applied to cable 16 and eventually allow slippage of cable 16 through clamping assembly 26 prior to realising its designed load capacity. Allowing for more rotation of lever arms 50, 52 (which requires more stroke from actuator shaft 80) from the fully open release position to a safely clamped position allows for more resilience to wear. However, in some applications increasing the stroke length of actuator shaft 80 is undesirable since this typically requires a larger housing 20. With reference to FIGS. 17A-17C, in the illustrated embodiment retraction of actuator shaft 80 causes approximately 15-20° of rotation of lever arms 50, 52 and hence cam pins 68 from the fully open release position of FIG. 17A to the intermediate/activated position of FIG. 17B wherein clamping surfaces 34, 40 engage cable 16. As explained above, further relative motion of housing 20 and cable 16 will cause further rotation of lever arms 50, 52 and hence cam pins 68 through a further arc of approximately 15-20° from the intermediate/activated position of FIG. 17B to the fully clamped position of FIG. 17C. Thus in this embodiment the total maximum range of rotation of levers arms 50, 52 and cam pins 68 is approximately 30-40°. In the embodiment of FIGS. 17A-17C this maximum range of rotation is constrained by the size of housing 20.

The inventor has determined that the amount of clamping force applied to cable 16 may be varied by altering the center-to-center spacing of half-round portions 70, 72 of each cam pin 68. That is, the center-to-center spacing of half-round portions 70, 72 is important in converting the rotational motion applied to them through lever arms 50, 52 to the generally linear clamping motion of curved clamping surfaces 34, 40 of shoe 28 and clamp 38. The farther apart the centers of half-round portions 70, 72, the more linear clamping motion that will result for each angle of rotation of levers 50, 52. Thus the clamping force can be optimized for higher load capacity applications while maintaining a comparatively short stroke length. With reference to FIGS. 6A-6F, the spacing between the respective centers of half-round portions 70, 72 along diametral line L is represented by distance S. The radius of each portion 70, 72 is represented by radius R. The diameter of each half-round portion 70, 72, i.e. as measured along line L, is 2R or D. The farther apart the centers, i.e the greater the distance S for portions 70, 72 of a particular radius R, the more linear clamping motion results for each angle of rotation of lever arms 50, 52. For example, in the embodiments of FIGS. 6A and 6B half-round portions 70, 72 have the same radius R and hence diameter D, but the center-to-center spacing is larger in FIG. 6B. Similarly, FIGS. 6C-6F illustrate embodiments with a constant radius R but progressively smaller spacing S, resulting in a progressively larger D/S ratio. In some embodiments the inventor has determined that a ratio of D/S between 2 and 3 is desirable. In one embodiment suitable for use in a lumber sorting apparatus a ratio of D/S of approximately 2.3 is desirable. In one particular exemplary embodiment the radius R of half-round portions 70, 72 may be 0.875 inches, the diameter D is 1.75 inches, the center-to-center spacing S is 0.75 inches and the ratio of D/S is approximately 2.3.

The maximum working load that can be safely immobilized by a locking system comprising locking apparatuses 10 is dependent on various factors. Typically a system employing 0.75 inch diameter cable 16 is engineered to accept a working load of 10,000 lbs per apparatus 10 or a total load of 20,000 lbs. This assumes a safety factor of about 5 to 1, i.e. a system that is rated to support a load of 20,000 lbs should be able to support a load 5 times that amount, or 100,000 lbs. If the locking system employs a 1 inch diameter cable it may safely accept a working load of 20,000 lbs per apparatus 10 or a total load of 40,000 lbs. Assuming the same 5 to 1 safety factor, such a locking system with a 1 inch diameter cable should be able to support a load 5 times that amount or 200,000 lbs. The size of cable 16 may also determine the optimum dimensions of half-round portions 70, 72 of cam pin 68. For example, in some embodiments the diameter of half-round portions 70, 72 may be approximately 1.75 times the diameter of cable 16. Thus, as discussed above, in one exemplary example, cable 16 may be about 1 inch in diameter, half-round portions 70, 72 may be about 1.75 inches in diameter (D) and the center-to-center spacing (S) of half-round portions 70, 72 may be about 0.75 inches, resulting in a ratio D/S of about 2.3. In another exemplary example, cable 16 may be about 1.25 inches in diameter, half-round portions 70, 72 may be about 2.9 inches in diameter (D) and the center-to-center spacing (S) of half-round portions 70, 72 may be about 1.26 inches, again resulting in a ratio D/S of about 2.3

In some applications problems may arise if ratio D/S is significantly more than 3 or less than 2. For example, in a compact apparatus 10 having an actuator 22 with a relatively short stroke length where lever arms 50, 52 are permitted to rotate 15-20° either side of an intermediate/activated position (i.e. a total of 30-40° of travel as described above), a ratio D/S above 3 may allow premature slippage of apparatus 10 and associated bin floor 14 and supported load 12 relative to cable 16 prior to meeting the rated working load capacity of the locking system. That is, a ratio of D/S above 3 may not result in sufficient clamping force in the locked position to prevent relative movement of apparatus 10 and cable 16 prior to failure of any internal components of apparatus 10, particularly in high load applications after some wear to the internal components. Conversely, a ratio D/S less than 2 may apply too much force to cable 16 in the locked position, potentially deforming internal components of apparatus 10 and requiring their premature replacement. By way of example, if excessive clamping force is applied to cable 16 this may result in damage to shoe 28, clamp 38, lever arms 50, 52 and/or cam pins 68 due to metal deformation such as by thinning or "necking" of the metal at stress locations, particularly in regions of lesser cross-section, or bending of metal components. For example, since the force moment of half-round portion 72 is larger than half-round portion 70 since it is further spaced-apart from lever arms 50, 52 (due to the intervening thickness of shoe 28 as best shown in FIG. 7), this may cause bending of half-round portion 72. Deformation of metal components of clamping system 26 may necessitate more frequent replacement of such components and/or the use of higher grade metal components, increasing the overall cost of the locking system. By way of specific example, if shoe 28 is made of thicker, higher grade metal plate, such as thicker steel, this would increase the cost of material acquisition and cost of manufacture to form shoes 28 in a U-shape.

The size of load 12 supported by bin floor 14 in a lumber sorting apparatus can vary widely depending for example on the size of the lumber, the number of lumber pieces loaded and the moisture content of the lumber. As explained above, in some prior art locking systems each locking apparatus is designed to accept a working load of 10,000 lbs per apparatus for a total loaded bin weight of 20,000 lbs. In some embodiments the applicant's apparatus 10 can accept a working load of 20,000 lbs per apparatus for a total loaded bin weight of 40,000 lbs. Thus in accordance with some embodiments the load capacity can be significantly increased without significantly increasing the stroke length of actuator shaft 80, the size of housing 20 or the overall dimensions of apparatus 10. In one example, by employing a 1 inch cable 16 and a D/S ratio of about 2.3 as described above the applicant's locking apparatus 10 may be only approximately 20% larger than prior art mechanical locking devices but support approximately twice the working load.

Although apparatus 10 has been described above in the context of a reciprocating lumber bin floor 14 travelling vertically, a person skilled in the art will understand that apparatus 10 may be applied in many other applications for releasably locking a suspended load at a desired location.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are consistent with the broadest interpretation of the specification as a whole.

The invention claimed is:

1. An elongated cam pin for use in a clamping apparatus, said pin comprising a first half-round portion and a second half-round portion laterally offset from said first half-round portion, wherein the centers of said first and second half-round portions are spaced-apart a distance S along a diametral center line of said pin, wherein each of said half-round portions has a radius R and a diameter D equal to 2R, and wherein the ratio D/S is between approximately 2 and approximately 3.

2. The cam pin as defined in claim 1, wherein said ratio is between approximately 2.1 and approximately 2.5.

3. The cam pin as defined in claim 2, wherein said ratio is approximately 2.3.

4. The cam pin as defined in claim 1, wherein said clamping apparatus comprises a clamping assembly for releasably locking a load to a cable.

5. The cam pin as defined in claim 4, wherein said load comprises a lumber sorting bin floor adapted for receiving and moving a supply of lumber.

6. The cam pin as defined in claim 5, wherein said clamping assembly comprises a U-shaped shoe and a clamp positionable within said shoe, wherein said pin extends transversely within apertures formed in said shoe and clamp and is rotatable relative thereto for applying a force to said shoe and said clamp, thereby causing said assembly to engage or disengage said cable.

7. The cam pin as defined in claim 6, wherein clamping apparatus has a working load capacity of a least 15,000 lbs.

8. The cam pin as defined in claim 7, wherein said clamping apparatus has a working load capacity of at least 20,000 lbs.

9. The cam pin as defined in claim 8, wherein said clamping apparatus has a working load capacity of at least 25,000 lbs.

10. The cam pin as defined in claim 6, wherein said cam pin is rotatable in said clamping apparatus between a fully open release position and a fully closed clamping position, wherein the arc of rotation of said cam pin between said fully open a fully closed positions is approximately 40° or less.

11. A locking system comprising at least one cam pin as defined in claim 1.

12. A locking apparatus comprising at least one cam pin as defined in claim 1 and a housing for supporting rotation of said cam pin relative to a longitudinal axis thereof.

13. A locking apparatus for locking a suspended load at a desired location relative to a fixed cable, wherein said locking apparatus has a working load capacity of at least 15,000 lbs and wherein said locking apparatus comprises at least one cam pin rotatable between a fully open release position and a fully closed clamping position, wherein the arc of rotation of said cam pin between said fully open and said fully closed positions is approximately 40° or less, wherein said locking apparatus comprises an actuator for actuating movement of said at least one cam pin between said fully open position and a closed position, wherein said actuator comprises an actuating shaft moveable within a housing, wherein the stroke length of shaft is 3 inches or less.

14. The locking apparatus as defined in claim 13, wherein said cam pin comprises a first half-round portion and a second half-round portion laterally offset from said first half-round portion, wherein the centers of said first and second half-round portions are spaced-apart a distance S along a diametral center line of said pin, wherein each of said half-round portions has a radius R and a diameter D equal to 2R, and wherein the ratio D/S is between approximately 2 and approximately 3.

15. The locking apparatus as defined in claim 14, wherein said ratio is between approximately 2.1 and approximately 2.5.

16. The locking apparatus as defined in claim 15, wherein said ratio is approximately 2.3.

17. A locking apparatus for releasably engaging a cable, wherein said locking apparatus comprises a clamping assembly comprising at least one rotatable cam pin comprising a first half-round portion and a second half-round portion laterally offset from said first half-round portion, wherein the centers of said first and second half-round portions are spaced-apart a distance S along a diametral center line of said pin, wherein each of said half-round portions has a radius R and a diameter D equal to 2R, wherein diameter D is approximately 1.75 times the diameter of said cable and wherein the ratio D/S is between approximately 2 and approximately 3.

18. The locking apparatus as defined in claim 17, wherein the diameter of said cable is about 1 inch or more.

19. The locking apparatus as defined in claim 18, wherein said ratio is between approximately 2.1 and approximately 2.5.

20. The locking apparatus as defined in any claim 19, wherein said ratio is approximately 2.3.

21. The locking apparatus as defined in claim 17 for releasably locking a load to said cable, wherein said load comprises a lumber sorting bin floor adapted for receiving and moving a supply of lumber.

22. The locking apparatus as defined in claim 21, wherein said clamping assembly comprises a U-shaped shoe and a clamp positionable within said shoe, wherein said pin extends transversely within apertures formed in said shoe and clamp and is rotatable relative thereto for applying a force to said shoe and said clamp, thereby causing said clamping assembly to engage or disengage said cable.

23. The locking apparatus as defined in claim 22, wherein said apparatus has a working load capacity of at least 15,000 lbs.

24. The locking apparatus as defined in claim 23, wherein said apparatus has a working load capacity of at least 20,000 lbs.

25. The locking apparatus as defined in claim 24, wherein said apparatus has a working load capacity of at least 25,000 lbs.

26. The locking apparatus as defined in claim 17, comprising a housing for supporting rotation of said at least one cam pin relative to a longitudinal axis thereof and an actuator for actuating movement of said at least one cam pin between a fully open position and a closed position, wherein said actuator comprises an actuating shaft moveable within said housing, wherein the stroke length of shaft is 3 inches or less.

27. The locking system as defined in claim 22, wherein said at least one cam pin is rotatable between a fully open release position and a fully closed clamping position, wherein the arc of rotation of said cam pin between said fully open and said fully closed positions is approximately 40° or less.

28. The locking apparatus as defined in claim 27, wherein said arc of rotation is between about 30° and about 40°.

29. The locking apparatus as defined in claim 17, wherein said diameter of said cable is approximately 1 inch, said diameter D of each of said half-round portions is approximately 1.75 inches, said radius R of each of said half-round portions is approximately 0.875 inches, said spacing S between said centers of said first and second half-round portions is approximately 0.75 inches, and said ratio D/S is approximately 2.3.

30. A locking system comprising a plurality of locking apparatuses as defined in claim 17.

* * * * *